US008102346B2

(12) United States Patent
Watanabe

(10) Patent No.: US 8,102,346 B2
(45) Date of Patent: Jan. 24, 2012

(54) ELECTRO-OPTICAL DEVICE AND ELECTRONIC APPARATUS INCLUDING THE SAME

(75) Inventor: Kenya Watanabe, Suwa (JP)

(73) Assignee: Sony Corporation, Tokyo (JP)

( * ) Notice: Subject to any disclaimer, the term of this patent is extended or adjusted under 35 U.S.C. 154(b) by 767 days.

(21) Appl. No.: 12/200,184

(22) Filed: Aug. 28, 2008

(65) Prior Publication Data

US 2009/0079684 A1 Mar. 26, 2009

(30) Foreign Application Priority Data

Sep. 20, 2007 (JP) ..... 2007-243441
Sep. 20, 2007 (JP) ..... 2007-243442

(51) Int. Cl.
*G09G 3/36* (2006.01)

(52) U.S. Cl. ..... 345/90; 345/92

(58) Field of Classification Search ..... 345/87, 345/90, 92
See application file for complete search history.

(56) References Cited

U.S. PATENT DOCUMENTS

2003/0011696 A1* 1/2003 Yamazaki ..... 348/312

FOREIGN PATENT DOCUMENTS

JP 2002341313 * 11/2002
JP A-2002-341313 11/2002

* cited by examiner

*Primary Examiner* — Chanh Nguyen
*Assistant Examiner* — Ram Mistry
(74) *Attorney, Agent, or Firm* — K&L Gates LLP

(57) ABSTRACT

An electro-optical device includes a pixel circuit with a driving transistor element, a storage capacitor, and a capacitive element. The driving transistor element is electrically connected to a corresponding data line and a corresponding driving electrode. The storage capacitor is electrically connected to the driving transistor element and the driving electrode. The storage capacitor holds an image signal supplied through the corresponding data line as potential at the driving electrode. The capacitive element is electrically connected to the driving transistor element and the driving electrode. The capacitive element compensates for a change in the potential of the driving electrode when the driving transistor element is switched from a selection state to a non-selection state. The capacitive element is supplied with a correction signal that defines timing at which the potential of the capacitive element is controlled.

10 Claims, 24 Drawing Sheets

ELECTRO-OPTICAL DEVICE AND ELECTRONIC APPARATUS INCLUDING THE SAME

BACKGROUND

1. Technical Field

The present invention relates to an electro-optical device, such as a liquid crystal device, and an electronic apparatus, such as a liquid crystal projector, including the electro-optical device.

2. Related Art

A liquid crystal device that is an example of an electro-optical device of this type includes a plurality of scanning lines and a plurality of data lines arranged vertically and horizontally in a display region having a plurality of pixels, and a plurality of pixel electrodes at intersections between the scanning lines and the data lines. The liquid crystal device is of an active matrix drive type in which pixel-switching TFTs (Thin Film Transistors) provided to correspond to the pixels are turned on/off, that is, are switched between a selection state and a non-selection state in accordance with scanning signals, and image signals are supplied from the data lines to the pixel electrodes through the pixel-switching TFTs, thereby performing image display.

When the liquid crystal device is driven and a corresponding pixel-switching TFT is switched from the selection state to the non-selection state, parasitic capacitance is generated with a gate insulating film of the pixel-switching TFT as a dielectric film. Parasitic capacitance causes a pushdown phenomenon in which the potential of the pixel electrode is lowered. Due to the pushdown phenomenon, the potential of the pixel electrode, which is set by the image signal to be supplied to the pixel electrode, is lowered, and accordingly display performance of the liquid crystal device is deteriorated. In a liquid crystal device that uses a driving method in which the image signal is supplied to a pixel electrode in forms of an analog signal, luminance of each pixel depends on a voltage to be applied to liquid crystal interposed between the pixel electrode and a counter electrode opposed to the pixel electrode. In such a liquid crystal device, the lowering of the potential of the pixel electrode has a direct effect on the luminance of the pixel, and significantly deteriorates the display performance of the liquid crystal device. The lowering of the potential of the pixel electrode occurs to a greater or lesser extent even if a storage capacitor is connected between the pixel-switching TFT and the pixel electrode in order to maintain the potential of the pixel electrode. JP-A-2002-341313 discloses a technology that suppresses the lowering of the potential of the pixel electrode due to the pushdown phenomenon.

In a liquid crystal device that is an example of an electro-optical device of this type, an inversion driving method, such as dot inversion, line inversion, or frame inversion, is used in order to prevent burning or aging of liquid crystal. In a liquid crystal device that uses an inversion driving method, the potential of the pixel electrode in each pixel has one of a positive polarity and a negative polarity in a positive write period or a negative write period according to the potential of the counter electrode opposed to the pixel electrode. The potential of the image signal to be written to the pixel electrode or the potential of the counter electrode is adjusted such that the voltage to be applied to liquid crystal in each period becomes constant.

In the technology disclosed in JP-A-2002-341313, there is a problem in that the configuration of a pixel circuit provided in each pixel for driving liquid crystal is complicated. In addition, when the pixel is reduced in size to allow high-definition images to be displayed in the display region, it is difficult to ensure a space in the pixels in which to dispose the TFTs and wiring lines connecting the TFTS. If the TFTs and the wiring lines can be formed in the pixels, the potential of the pixel electrode may be lowered due to parasitic capacitance between the element, such as the TFT, and the wiring line, and the image signal may be insufficiently written to the pixel electrode. In addition, in the electro-optical device of this type, a precharge operation to precharge a data line may be performed after a first frame period of adjacent frame periods such that the potential of the image signal to be supplied to the data line is not changed during a subsequent frame period. According to the technology disclosed in JP-A-2002-341313, in order to suppress lowering of the potential of the pixel electrode, a predetermined period is needed after the image signal is written to the pixel electrode. For this reason, it becomes technically difficult to ensure a period in which the precharge operation is to be executed.

In the liquid crystal device that uses an inversion driving method, an image signal whose potential is adjusted by means of an external circuit, such as an image signal supply circuit, is supplied to a data line. For this reason, adjustment of the potential of the image signal becomes complicated, and the configuration of the external circuit, which executes such adjustment, also becomes complicated. In addition, it is necessary to adjust the potential of a positive-polarity image signal or a negative-polarity image signal to be higher than a target potential in advance. Accordingly, in driving the pixel-switching TFT for supplying the image signal to the pixel electrode, the voltage of the scanning line to be applied from the scanning line to the TFT needs to be increased, and voltage resistance of the scanning lines needs to be increased.

SUMMARY

An advantage of some aspects of the invention is that it provides an electro-optical device capable of compensating for lowering of a potential of a pixel electrode due to a pushdown phenomenon occurring when a pixel-switching TFT is switched from a selection state to a non-selection state, that is, insufficient writing of an image signal, and an electronic apparatus, such as a display device, including the electro-optical device.

According to a first aspect of the invention, an electro-optical device includes a plurality of data lines and a plurality of scanning lines that are formed to intersect each other in a display region on a substrate, and a plurality of pixel circuits that control driving of a plurality of pixel circuits correspondingly provided at intersections of the plurality of data lines and the plurality of scanning lines. Each of the pixel circuits includes a driving electrode that drives a corresponding display element, a driving transistor element that controls driving of the display element through the driving electrode, the driving transistor element having an input terminal that is electrically connected to a corresponding data line and to which an image signal is input through the data line, an output terminal that is electrically connected to the driving electrode and outputs the image signal to the driving electrode, and a gate electrode that is electrically connected to a corresponding scanning line, a storage capacitor that maintains the electrode potential of the driving electrode set according to the potential of the image signal, the storage capacitor having a first capacitor electrode that is electrically connected to the output terminal, and a second capacitor electrode that constitutes a pair of capacitor electrodes, together with the first capacitor electrode, and a switching unit that is electrically connected to a fixed potential line, to which a fixed potential is supplied, and the second capacitor electrode, and switches an electrical connection state between the fixed potential line and the second capacitor electrode in accordance with a correction signal. The switching unit switches the connection state from a conduction state to a non-conduction state before a first time at which the driving transistor element is to be switched from a selection state to a non-selection state again after being switched from the non-selection state to the selection state, and switches the connection state from the non-conduction state to the conduction state after the first time.

In the electro-optical device according to the first aspect of the invention, the term 'display element' means a modulation element, such as a liquid crystal element, which emits display light by light modulation, or a self-luminous element, such as an EL element, and constitutes a part of the pixel circuit, together with the driving electrode. The term 'driving electrode' means an electrode that applies a voltage to the display element or supplies a current to the display element so as to drive the display element. Specifically, when the display element is a liquid crystal element, the driving electrode is a pixel electrode that is provided in each pixel so as to apply a driving voltage to liquid crystal. When the display element is a self-luminous element, such as an EL element, the driving electrode is an electrode that is electrically connected to a light-emitting layer so as to supply a driving current to the light-emitting layer. The driving electrode applies a voltage to the display element or supplies a current to the display element according to the image signal supplied through a driving transistor element described below.

The driving transistor element has an input terminal which is electrically connected to a corresponding data line and to which an image signal is input through the data line, an output terminal which is electrically connected to the driving electrode and outputs the image signal to the driving electrode, and a gate electrode which is electrically connected to a corresponding scanning line, and controls the driving through the driving electrode. The input terminal and the output terminal are electrically connected to a source region and a drain region of the driving transistor element, respectively. For example, when the electro-optical device is a liquid crystal device that uses an inversion driving method, the source region and the drain region electrically connected to the terminals, respectively, are switched each other in accordance with the potential of the image signal. Specifically, for example, when the driving transistor element is an N-channel type TFT, and a positive-polarity image signal is supplied to the input terminal, the input terminal functions as a terminal electrically connected to the source region, and the output terminal functions as a terminal electrically connected to the drain region. To the contrary, when a negative-polarity image signal is supplied to the input terminal, the input terminal functions as a terminal electrically connected to the drain region, and the output terminal functions as a terminal electrically connected to the source region. Such a driving transistor element is configured so as to be switched between the selection state and the non-selection state, that is, such that the channel region of the driving transistor element is switched between the conduction state and the non-conduction state, in accordance with the scanning signal supplied to the gate electrode through the scanning line. The driving of the display element is controlled by a voltage to be applied to the display element through the driving electrode or a current to be supplied to the display element through the driving electrode.

The storage capacitor has a first capacitor electrode which is electrically connected to the output terminal, and a second capacitor electrode which constitutes a pair of capacitor electrodes, together with the first capacitor electrode, and maintains the electrode potential of the driving electrode set according to the potential of the image signal. The storage capacitor has a laminate structure in which a dielectric layer, which is a part of an interlayer insulating film formed on the substrate, is interposed between the first capacitor electrode and the second capacitor electrode serving as a pair of capacitor electrodes. When a liquid crystal device serving as an example of the electro-optical device operates, the second capacitor electrode is supplied with the same potential as that of a counter electrode opposed to the driving electrode serving as a pixel electrode or a fixed potential different from a common potential supplied to the counter electrode, and operates to maintain the electrode potential of the driving electrode.

The switching unit is electrically connected to the fixed potential line, to which the fixed potential is supplied, and the second capacitor electrode. The switching unit can switches the electrical connection state between the fixed potential line and the second capacitor electrode in accordance with the correction signal. The term 'fixed potential' used herein may be a predetermined potential different from the common potential supplied to the counter electrode or the common potential supplied to the counter electrode, as described above. The switching unit is, for example, a transistor element or a circuit including a transistor element. The switching unit is configured to switch the conduction state and the non-conduction state between the fixed potential line and the second capacitor electrode in accordance with the correction signal.

In particular, in the electro-optical device according to the first aspect of the invention, the switching unit switches the electrical connection state between the fixed potential line and the second capacitor electrode from the conduction state to the non-conduction state before the first time at which the driving transistor element is switched from the selection state to the non-selection state again after being switched from the non-selection state to the selection state. Therefore, a node in a connection path between the switching unit and the storage capacitor is electrically isolated from the fixed potential line before the first time, and the node is put in a floating state.

Subsequently, at the first time, if the driving transistor element is switched from the selection state to the non-selection state, capacitance coupling is produced between the gate and drain of the driving transistor element, and the potential of the driving electrode is lowered due to capacitance coupling. For this reason, even if the image signal is supplied to the driving electrode through the data line and the driving transistor element while the driving transistor element is in the selection state, it becomes difficult to maintain the electrode potential of the driving electrode at a potential according to the image signal.

Therefore, after the first time, the switching unit switches the connection state from the non-conduction state to the conduction state. With this structure, a change in the potential of the driving electrode, that is, lowering of the potential is transmitted to the node in the connection path between the storage capacitor and the switching unit, and thus the change in the potential of the driving electrode is compensated. Specifically, while the connection state between the fixed potential line and the second capacitor electrode is in the non-conduction state, the potential of the nose constituting a part of the connection path between the switching unit and the second capacitor electrode is different from the fixed potential. If the connection state between the second capacitor electrode and the fixed potential line is switched to the conduction state, the potential of the node constituting a part of the connection path between the switching unit and the second capacitor electrode is the same as the fixed potential. The change in the potential of the node constituting a part of the connection path between the switching unit and the second capacitor electrode causes a change in capacitance of the storage capacitor. If capacitance of the storage capacitor is changed, the potential of a node constituting a part of a connection path between the first capacitor electrode and the output terminal is changed, that is, raised. The change in the potential of the node constituting a part of the connection path between the first capacitor electrode and the output terminal makes it possible to compensate for the electrode potential of the driving electrode due to the pushdown phenomenon. That is, according to the electro-optical device having the above-described configuration, it is possible to compensate for the change in the electrode potential of the driving electrode when the driving transistor element is switched from the selection state to the non-selection state.

In addition, when the electrical connection state between the second capacitor electrode and the fixed potential line is in the non-conduction state, specifically, when the node between the switching unit and the second capacitor electrode is electrically isolated from the fixed potential and in the floating state, the change in the potential of the node between the output terminal and the first capacitor electrode causes a change in the potential of the node between the second capacitor electrode and the switching unit by capacitance coupling in the storage capacitor. In this state, after the first time, by switching the connection state between the second capacitor electrode and the fixed potential line from the non-conduction state to the conduction state, the potential of the node between the second capacitor electrode and the switching unit can be approximated to the fixed potential. The change in the potential of the node makes it possible to compensate for the potential of the node between the output terminal and the first capacitor electrode, that is, the potential of the driving electrode by using the storage capacitor.

Therefore, according to the electro-optical device having the above-described configuration, the change in the electrode potential of the driving electrode can be compensated, without needing an image signal whose potential is set so as to compensate for the change in the potential of the driving electrode, and occurrence of insufficient writing of the image signal to the driving electrode can be suppressed. In addition, even if the potential of the data line is changed while the driving transistor element is selected, the electrode potential of the driving electrode can be prevented from being changed due to the change in the potential of the data line. As a result, the change in the potential of the data line due to coupling capacitance between the data lines or the data lines and other wiring lines can be prevented from being transmitted to the driving electrode.

As such, according to the electro-optical device having the above-described configuration, the change in the potential of the driving electrode occurring when the driving transistor element is switched from the selection state to the non-selection state, specifically, lowering of the potential due to the pushdown phenomenon can be suppressed, and the potential of the driving electrode can be maintained (that is, held) at a potential according to the potential of the image signal. Therefore, defective display due to the change in the potential of the driving electrode can be reduced. In particular, when the image signal is in forms of an analog signal, the alignment of liquid crystal in a liquid crystal element serving as an example of a display element is determined in advance by a V-T curve, which defines a voltage V applied to liquid crystal and a time T for which the voltage V is maintained. As a result, if the potential of the driving electrode serving as a pixel electrode can be maintained (that is, held) for a longer time, a variation in luminance of the pixel with respect to target luminance can be effectively suppressed, and display performance of the electro-optical device can be increased.

According to the electro-optical device having the above-described configuration, immediately after the driving transistor element is switched from the selection state to the non-selection state, the electrical connection state between the second capacitor electrode and the fixed potential can be switched from the non-conduction state to the conduction state. Therefore, a precharge period in which the data line is precharged can be ensured.

The electro-optical device according to the first aspect of the invention may further include a sampling circuit that has a sampling switch for sampling the image signal and supplying the sampled image signal to the data line. In this case, the switching unit may switch the connection state from the conduction state to the non-conduction state before a second time at which the sampling switch is to be switched from the selection state to the non-selection state again after being switched from the non-selection state to the selection state by a sampling signal.

With this configuration, when the electro-optical device operates, the image signal is one of N image signals subjected to serial-parallel conversion, and is supplied to a set of image signal lines from among N image signal lines and the sampling circuit. In order to suppress an increase in a driving frequency and realize high-definition image display, the N image signals are generated by converting serial image signals into a plurality of parallel image signals of 3-phase, 6-phase, 12-phase, 24-phase, . . . by using an external circuit. Together with the supply of the image signals, the data line driving circuit sequentially supplies sampling signals to sampling switches corresponding data line groups each including a plurality of data lines. Then, the sampling switches are switched from the non-selection state to the selection state. If doing so, the N image signals are sequentially supplied to a plurality of data lines for every data line group in accordance with the sampling signal by the sampling circuit. Therefore, the data lines belonging to the same data line group are driven simultaneously.

The switching unit can switch the connection state between the second capacitor electrode and the fixed potential line from the conduction state to the non-conduction state before the second time at which the sampling switch is to be switched from the selection state to the non-selection state again after being switched from the non-selection state to the selection state by the sampling signal.

Therefore, according to the above-described configuration, even if coupling capacitance occurs between the sampling switch and the data line when the sampling switch constituted by a switching element, such as a TFT, is switched from the selection state to the non-selection state, and the potential of the data line is changed due to coupling capacitance, the change in the potential can be compensated. That is, after the first time, by switching the connection state between the second capacitor electrode and the fixed potential from the non-conduction state to the conduction state, the change in the electrode potential of the driving electrode occurring when the sampling switch is switched from the conduction state to the non-conduction state is compensated.

Therefore, with this configuration, in addition to the driving transistor element, the change in the electrode potential due to the switching operation of the sampling switch can be compensated, and thus the display performance of the electro-optical device can be further increased.

The electro-optical device according to the first aspect of the invention may further include a capacitance unit that is electrically connected to a connection path electrically connecting the second capacitor electrode and the switching unit, and the output terminal.

With this configuration, even if the change in the electrode potential may be insufficiently compensated only with compensation of the change in the electrode potential by the storage capacitor, which is performed by switching of the connection state between the second capacitor electrode and the fixed potential, by setting capacitance of the capacitance unit to be larger than capacitance of the storage capacitor, the change in the electrode potential can be compensated.

In the electro-optical device according to the first aspect of the invention, the switching unit may be a switching transistor element being of the same conduction type as the driving transistor.

With this configuration, by doping a common impurity into a semiconductor layer formed on a substrate by using a common semiconductor manufacturing process, that is, by a common implantation process, the driving transistor element and the switching transistor element can be formed together. In addition, since the elements can be formed by the common implantation process, an interval between the elements can be narrowed, as compared with a case in which different impurities are doped in the semiconductor layer. That is, as for the elements, what is necessary is that the active layers formed by the implantation process are of the same conduction type. Therefore, even if regions on the substrate where the driving transistor element and the switching transistor element are to be formed are set close to each other, there is no case in which the active layers being of different conduction types are formed, and the transistor elements being of the conduction types as designed can be formed. Specifically, the driving transistor element and the switching transistor element may be p-channel type transistor elements or n-channel type transistor elements.

Therefore, with this configuration, the interval between the driving transistor element and the switching transistor element can be narrowed, and thus the pixel circuit can be reduced in size. As a result, with this configuration, the pitch of each pixel on the substrate on which the pixel circuit is to be formed can be made fine, and thus high definition of images to be displayed in the display region can be achieved.

In addition, with this configuration, the conduction types of the driving transistor element and the switching transistor element can be selected depending on the polarities of the scanning signal and the correction signal.

The electro-optical device according to the first aspect of the invention may further include a correction signal line that is electrically connected to a gate of the switching transistor element, and a correction signal supply circuit that supplies the correction signal to the correction signal line. In this case, the correction signal supply circuit may set the correction signal at a predetermined potential such that the switching transistor element is to be switched between the conduction state and the non-conduction state.

With this configuration, when the switching transistor element is turned on/off, the size of a potential to be input to the element, that is, the polarity of the gate voltage varies depending on the conduction type of the element. Therefore, the correction signal supply circuit sets the correction signal at a predetermined potential such that the switching transistor element can switch the connection state between the second capacitor electrode and the fixed potential from the conduction state to the non-conduction state or vice versa. The term 'predetermined potential' means a potential set according to the conduction type of the element such that the switching transistor element can be turned on/off. Specifically, if the switching transistor element is an n-channel type transistor element, when the switching transistor element is put in the selection state, the potential of the correction signal is set to be higher than that when the switching transistor element is put in the non-selection state, such that a positive gate voltage is applied to the gate of the switching transistor element.

As a result, with this configuration, a switching process for turning on/off the switching transistor element can be performed in accordance with the correction signal supplied from the correction signal supply circuit.

Moreover, the correction signal line electrically connected to a single pixel circuit may include a plurality of wiring lines. If the correction signal line includes the plurality of wiring lines, the correction signal can be supplied to the pixel circuit in forms of a plurality of auxiliary correction signals, and thus a load on a single wiring line when the correction signal is supplied can be reduced.

In the electro-optical device according to the first aspect of the invention, the correction signal line may be electrically connected to two adjacent pixel circuits from among the plurality of pixel circuits along an extension direction of the data line, and the correction signal may be individually supplied to the two pixel circuits.

With this configuration, the number of correction signal lines can be reduced, as compared with a case in which the correction signal line is provided for each row of the scanning lines.

In the electro-optical device according to the first aspect of the invention, a difference between the potential of the correction signal and the fixed potential may be the same as a threshold voltage of the switching transistor element.

With this configuration, if the switching transistor element is an n-channel type transistor element, when the switching transistor element is switched from the off state to the on state, that is, it is switched from the non-selection state to the selection state, the correction signal at a potential higher by the threshold voltage than the fixed potential is input to the gate of the switching transistor element. In addition, if the switching transistor element is a p-channel type transistor element, when the switching transistor element is switched from the off state to the on state, that is, it is switched from the non-selection state to the selection state, the correction signal at a potential lower by the threshold voltage than the fixed potential is input to the gate of the switching transistor element.

As a result, with this configuration, the on/off operation to switch the channel region of the switching transistor element between the conduction state and the non-conduction state can be accurately performed. In addition, when the switching transistor element is selected, the potential of the second capacitor electrode can be set to the fixed potential.

In the electro-optical device according to the first aspect of the invention, the correction signal may be at the same potential as a scanning signal supplied to the gate electrode through the scanning line.

With this configuration, the potential of the second capacitor electrode, that is, the potential of the node between the second capacitor electrode and the switching unit can be set to be same as the fixed potential.

In the electro-optical device according to the first aspect of the invention, the correction signal may include a plurality of auxiliary correction signals.

With this configuration, by supplying the correction signal in forms of a plurality of auxiliary correction signals, the load of the correction signal line can be reduced. In addition, the plurality of auxiliary correction signals may be supplied with a time shift.

In the electro-optical device according to the first aspect of the invention, the correction signal may include an auxiliary correction signal and an inverted auxiliary correction signal, and the switching unit may be a CMOS circuit that is to be switched between the conduction state and the non-conduction state in accordance with the auxiliary correction signal and the inverted correction signal.

With this configuration, coupling capacitance is not produced in the data line when the sampling switch is switched from the selection state to the non-selection state. Therefore, before the second time at which the sampling switch is to be switched from the selection state to the non-selection state, it is not necessary to switch the connection state between the second capacitor electrode and the fixed potential from the conduction state to the non-conduction state. As a result, the control of the switching unit by the correction signal can be simplified.

According to a second aspect of the invention, an electro-optical device includes a plurality of data lines and a plurality of scanning lines that are formed to intersect each other in a display region on a substrate, and a plurality of pixel circuits that control driving of a plurality of pixel circuits correspondingly provided at intersections of the plurality of data lines and the plurality of scanning lines. Each of the pixel circuits includes a driving electrode that drives a corresponding display element, a driving transistor element that controls driving of the display element through the driving electrode, the driving transistor element having an input terminal that is electrically connected to a corresponding data line and to which an image signal is input through the data line, an output terminal that is electrically connected to the driving electrode and outputs the image signal to the driving electrode, and a gate electrode that is electrically connected to a corresponding scanning line, a storage capacitor that maintains the electrode potential of the driving electrode set according to the potential of the image signal, the storage capacitor having a first capacitor electrode that is electrically connected to a fixed potential line, to which a fixed potential is supplied, and a second capacitor electrode that is electrically connected to a node in a connection path electrically connecting the driving electrode and the output terminal, and constitutes a pair of capacitor electrodes, together with the first capacitor electrode, and a capacitance unit that, between a correction signal line, to which a correction signal is supplied from a correction signal supply circuit, and the node, is electrically connected to the correction signal line and the node, and when the driving transistor element is switched from a selection state to a non-selection state, compensates for a first change in potential of the node in accordance with the correction signal.

In the electro-optical device according to the second aspect of the invention, the display element, means a modulation element, such as a liquid crystal element, which emits display light by light modulation, or a self-luminous element, such as an EL element, and constitutes a part of the pixel circuit, together with the driving electrode. The term 'driving electrode' means an electrode that applies a voltage to the display element or supplies a current to the display element so as to drive the display element. Specifically, when the display element is a liquid crystal element, the driving electrode is a pixel electrode that is provided in each pixel so as to apply a driving voltage to liquid crystal. When the display element is a self-luminous element, such as an EL element, the driving electrode is an electrode that is electrically connected to a light-emitting layer so as to supply a driving current to the light-emitting layer. The driving electrode applies a voltage to the display element or supplies a current to the display element according to the image signal supplied through a driving transistor element described below.

The driving transistor element has an input terminal which is electrically connected to a corresponding data line and to which an image signal is input through the data line, an output terminal which is electrically connected to the driving electrode and outputs the image signal to the driving electrode, and a gate electrode which is electrically connected to a corresponding scanning line, and controls the driving through the driving electrode. The input terminal and the output terminal are electrically connected to a source region and a drain region of the driving transistor element, respectively. For example, when the electro-optical device is a liquid crystal device that uses an inversion driving method, the source region and the drain region electrically connected to the terminals, respectively, are switched each other in accordance with the potential of the image signal. Specifically, for example, when the driving transistor element is an N-channel type TFT, and a positive-polarity image signal is supplied to the input terminal, the input terminal functions as a terminal electrically connected to the source region, and the output terminal functions as a terminal electrically connected to the drain region. To the contrary, when a negative-polarity image signal is supplied to the input terminal, the input terminal functions as a terminal electrically connected to the drain region, and the output terminal functions as a terminal electrically connected to the source region. Such a driving transistor element is configured so as to be switched between the selection state and the non-selection state, that is, the channel region of the driving transistor element is switched between the conduction state and the non-conduction state, in accordance with the scanning signal supplied to the gate electrode through the scanning line. The driving of the display element is controlled by a voltage to be applied to the display element through the driving electrode or a current to be supplied to the display element through the driving electrode.

The storage capacitor has a first capacitor electrode that is electrically connected to a fixed potential line, to which a fixed potential is supplied, and a second capacitor electrode that is electrically connected to a node in a connection path electrically connecting the driving electrode and the output terminal, and constitutes a pair of capacitor electrodes, together with the first capacitor electrode. The storage capacitor maintains the electrode potential of the driving electrode set according to the potential of the image signal.

The node is provided in the connection path electrically connecting the driving electrode and the output terminal, and in the circuit configuration, the potential of the node is the same as the potential of the driving electrode. Therefore, if the electrode potential of the driving electrode to which the image signal is supplied is changed, the potential of the node is change depending on the change in the electrode potential.

The storage capacitor has a laminate structure in which a dielectric layer, which is a part of an interlayer insulating film formed on the substrate, is interposed between the first capacitor electrode and the second capacitor electrode serving as a pair of capacitor electrodes. When a liquid crystal device serving as an example of the electro-optical device operates, the first capacitor electrode is supplied with the same potential as that of a counter electrode opposed to the driving electrode serving as a pixel electrode or a fixed potential different from a common potential supplied to the counter electrode, and operates to maintain the electrode potential of the driving electrode.

Between the correction signal line, to which the correction signal is supplied from the correction signal supply circuit, and the node, the capacitance unit is electrically connected to the correction signal line and the node. On the basis of the correction signal, the capacitance unit compensates for the first change in the potential of the node when the driving transistor element is switched from the selection state to the non-selection state.

The correction signal supply circuit is a circuit that constitutes a part of the scanning line driving circuit for supplying the scanning signals to the scanning lines or a circuit that is provided separately from the scanning line driving circuit. When the electro-optical device operates, the correction signal supply circuit supplies the correction signal to the capacitance unit through the correction signal lines provided to correspond to the scanning lines.

The capacitance unit refers to gate capacitance in which the gate insulating film of the driving transistor element or an insulating film formed in the same layer as the gate insulating film is used as a dielectric film, SD junction capacitance between the source region and the drain region of the driving transistor element, a capacitive element in which wiring lines on the substrate are used as a pair of electrodes, and an insulating film extending between the electrodes is used as a dielectric film, parasitic capacitance between the wiring lines, or various capacitance circuits that generates capacitance by using other transistor elements. What is necessary is that the capacitance unit operates to compensate for the first change in the potential of the node when the driving transistor element is switched from the selection state to the non-selection state. Specifically, what is necessary is that the capacitance unit can compensate for electric charges corresponding to the amount of electric charges from the node, that is, the driving electrode when the driving transistor element is switched from the selection state to the non-selection state.

According to the electro-optical device having the above-described configuration, the lowering of the potential of the driving electrode occurring when the driving transistor element is switched from the selection state to the non-selection state can be suppressed, and the potential of the driving electrode can be maintained (that is, held) at a potential according to the potential of the image signal. Therefore, defective display due to the change in the potential of the driving electrode can be reduced. In particular, when the image signal is in forms of an analog signal, the alignment of liquid crystal in a liquid crystal element serving as an example of a display element is determined in advance by a V-T curve, which defines a voltage V applied to liquid crystal and a time T for which the voltage V is maintained. As a result, if the potential of the driving electrode serving as a pixel electrode can be maintained (that is, held) for a longer time, a variation in luminance of the pixel with respect to the target luminance can be effectively suppressed, and display performance of the electro-optical device can be increased.

According to the electro-optical device having the above-described configuration, immediately after the driving transistor element is switched from the selection state to the non-selection state, the correction signal can be supplied to the capacitance unit. Therefore, a precharge period in which the data line is precharged can be ensured. In addition, the electrode potential of the driving electrode can be compensated, without supplying a corrected image signal from an external circuit separately provided from the pixel circuit. Therefore, the circuit configuration on the substrate can be simplified. As a result, even if the pixel size is set to be small for high definition of images, the pixels can be made fine, while an increase in the size of the pixel circuit in each pixel can be suppressed so as to be as small as possible.

In the electro-optical device according to the second aspect of the invention, the correction signal supply circuit may change the potential of the correction signal from a first potential to a second potential ahead of a first time at which the driving transistor element is to be switched from the selection state to the non-selection state, and may change the potential of the correction signal from the second potential to the first potential after the first time.

With this configuration, the first change, that is, the change in the electrode potential of the driving electrode, to be compensated by the capacitance unit can be specified in accordance with the difference between the first potential and the second potential. Therefore, the electrode potential can be simply maintained, as compared with a case in which the potential of the image signal is adjusted.

The electro-optical device according to the second aspect of the invention may further include a sampling circuit that has a sampling switch for sampling the image signal and supplying the sampled image signal to the data line, and a data line driving circuit that switches the sampling switch from the non-selection state to the selection state such that the image signal is supplied to the data line by the sampling switch. The correction signal supply circuit may change the potential of the correction signal from the first potential to the second potential ahead of a second time at which the sampling switch is to be switched from the selection state to the non-selection state, and the capacitance unit may compensate for a second change in the potential of the node when the sampling switch is switched from the selection state to the non-selection state.

With this configuration, when the electro-optical device operates, the image signal is one of N image signals subjected to serial-parallel conversion, and is supplied to a set of image signal lines from among N image signal lines and the sampling circuit. In order to suppress an increase in a driving frequency and realize high-definition image display, the N image signals are generated by converting serial image signals into a plurality of parallel image signals of 3-phase, 6-phase, 12-phase, 24-phase, . . . by using an external circuit. Together with the supply of the image signals, the data line driving circuit sequentially supplies sampling signals to sampling switches corresponding data line groups each including a plurality of data lines. If doing so, the N image signals are sequentially supplied to a plurality of data lines for every data line group in accordance with the sampling signal by the sampling circuit. Therefore, the data lines belonging to the same data line group are driven simultaneously. Moreover, the sampling switch is constituted by, for example, a TFT, and an output side thereof is connected to the data line. The sampling switch is switched from the non-selection state to the selection state in accordance with the sampling signal to be supplied to a gate thereof, and then the image signal is supplied to the data line.

When the sampling switch electrically connected to the data line is switched from the selection state to the non-selection state, similarly to when the driving transistor element is switched from the selection state to the non-selection state, the potential of the node, that is, the electrode potential of the driving electrode is changed. For this reason, it becomes difficult to maintain the electrode potential due to the second change corresponding to the change in the electrode potential. Therefore, the correction signal supply circuit changes the potential of the correction signal from the first potential to the second potential ahead of the second time at which the sampling switch is to be switched from the selection state to the non-selection state. The capacitance unit compensates for the change in the potential of the node occurring when the sampling switch is switched from the selection state to the non-selection state.

As a result, with this configuration, the change in the electrode potential due to the second change, as well as the first change, can be suppressed, and thus higher-quality images can be displayed, as compared with a case in which only the first change is compensated.

In the electro-optical device according to the second aspect of the invention, a combination of a differential voltage, which is a difference between the first potential and the second potential, and capacitance of the capacitance unit may be set so as to compensate for at least the first change from among the first change and the second change.

With this configuration, even if design of the capacitance unit is limited and capacitance is limited, by appropriately setting the differential voltage, at least the first change from among the first change and the second change can be compensated. In addition, when the set value of the differential voltage is limited, by appropriately setting capacitance, at least the first change from among the first change and the second change can be compensated. Therefore, with this configuration, at least the first change can be compensated with at least one of the differential voltage and capacitance as parameters. As a result, the degree of freedom in design of the capacitance unit on the substrate and the degree of freedom in the set value of the differential voltage can be increased.

In the electro-optical device according to the second aspect of the invention, the correction signal line may include a plurality of auxiliary correction signal lines, the correction signal may include a plurality of auxiliary correction signals that are supplied to the plurality of auxiliary correction signal lines from the correction signal supply circuit, and the capacitance unit may include a plurality of auxiliary capacitance units that are electrically connected to the node. In this case, the plurality of auxiliary capacitance units share compensation of at least the first change from among the first change and the second change in accordance with the plurality of auxiliary correction signal lines.

With this configuration, as compared with a case in which at least the first change from among the first change and the second change is compensated by a single capacitance unit, an influence of the single capacitance unit on other pixel circuits can be reduced. Specifically, since the change in the potential to be compensated by each of the plurality of auxiliary capacitance units is smaller than the first change, a change in the electrode potential in a pixel circuit can be suppressed with respect to the change in the potential of the driving electrode in the pixel unit caused by a capacitance unit having a single capacitive element.

When the electro-optical device is a liquid crystal device that uses an inversion driving method, the plurality of capacitance units can separately compensate for the electrode potentials of the driving electrodes to which the image signals having different polarities are supplied.

In the electro-optical device according to the second aspect of the invention, the correction signal supply circuit may correspondingly supply the plurality of auxiliary correction signals to the plurality of auxiliary correction signal lines at different timings, and the plurality of auxiliary capacitance units may compensate for at least the first change from among the first change and the second change along a time axis in a stepwise manner.

With this configuration, the term 'stepwise manner' means that the plurality of auxiliary capacitance units compensate for at least the first change along the time axis in a shared manner. Therefore, with this configuration, at least the first change can be compensated slowly, as compared with a case in which the plurality of auxiliary capacitance units compensate for at least the first change at the same timing, and occurrence of parasitic capacitance in other pixel circuits can be reduced.

In the electro-optical device according to the second aspect of the invention, slope portions, which are specified by the changes in potential of the plurality of auxiliary correction signals with respect to the time axis, in the waveforms of the plurality of auxiliary correction signals may have different slopes with respect to the time axis.

With this configuration, capacitance coupling between the node and other conductive portions, such as wiring lines, can be reduced by the plurality of auxiliary capacitance units, which operate in accordance with the plurality of auxiliary correction signals, respectively. In addition, coupling capacitance due to the common potential supplied to the counter electrode in the display element, such as a liquid crystal element, and the potential of the node can be reduced.

In the electro-optical device according to the second aspect of the invention, the plurality of auxiliary capacitance units may have different capacitances.

With this configuration, at least the first change from among the first change and the second change can be compensated. In addition, capacitance coupling between the node and other conductive portions, such as wiring lines, can be reduced, and coupling capacitance due to the common potential supplied to the counter electrode in the display element, such as a liquid crystal element, and the potential of the node can be reduced.

In the electro-optical device according to the second aspect of the invention, the first potential may vary in accordance with the plurality of auxiliary correction signals, and the second potential may vary in accordance with the plurality of auxiliary correction signals.

With this configuration, the degree of freedom in the set values of the first potential and the second potential for defining the differential voltage can be increased.

In the electro-optical device according to the second aspect of the invention, a differential voltage, which is difference between the first potential and the second potential in each of the plurality of auxiliary correction signals, may vary in accordance with the plurality of auxiliary correction signals.

With this configuration, the change in the potential of the node can be reduced while an influence on the other pixel circuits can be suppressed.

In the electro-optical device according to the second aspect of the invention, the sampling switch may be a sampling transistor element. In this case, the correction signal supply circuit may be formed in parallel to at least one of the sampling transistor element and the driving transistor element, and may include a transistor element for a supply circuit having the same design as the one transistor element.

With this configuration, a voltage to be compensated by a single correction signal or each of the plurality of auxiliary correction signals can be made to be the same as the threshold voltage of at least one of the sampling transistor element and the driving transistor element. Specifically, as compared with a case in which a plurality of auxiliary correction signals are output through a transistor element different from a transistor element for a supply circuit, which is formed in parallel to at least one of the sampling transistor element and the driving transistor element and has the same design as the at least one element, a variation in potential between the plurality of auxiliary correction signals can be reduced.

According to a third aspect the invention, an electronic apparatus includes the above-described electro-optical device.

The electronic apparatus according to the third aspect of the invention includes the above electro-optical device, and thus it can perform high-quality display. As the electronic apparatus, various electronic apparatuses, such as a projection-type display device, such as a projector, a mobile phone, an electronic organizer, a word processor, a viewfinder-type or monitor-direct-view-type video tap recorder, a workstation, a video phone, a POS terminal, and a touch panel, may be exemplified. In addition, an electrophoretic device, such as an electronic paper, may be exemplified.

The above and other advantages and features will be apparent from embodiments described below.

BRIEF DESCRIPTION OF THE DRAWINGS

The invention will be described with reference to the accompanying drawings, wherein like members reference like elements.

DESCRIPTION OF EXEMPLARY EMBODIMENTS

Embodiments of an electro-optical device according to the invention and an electronic apparatus according to the invention will be described with reference to the drawings.

First Embodiment

First, an embodiment of an electro-optical device according to the invention will be described with reference to FIGS. 1 to 12.

Overall Configuration of Electro-Optical Device

Figure 1:
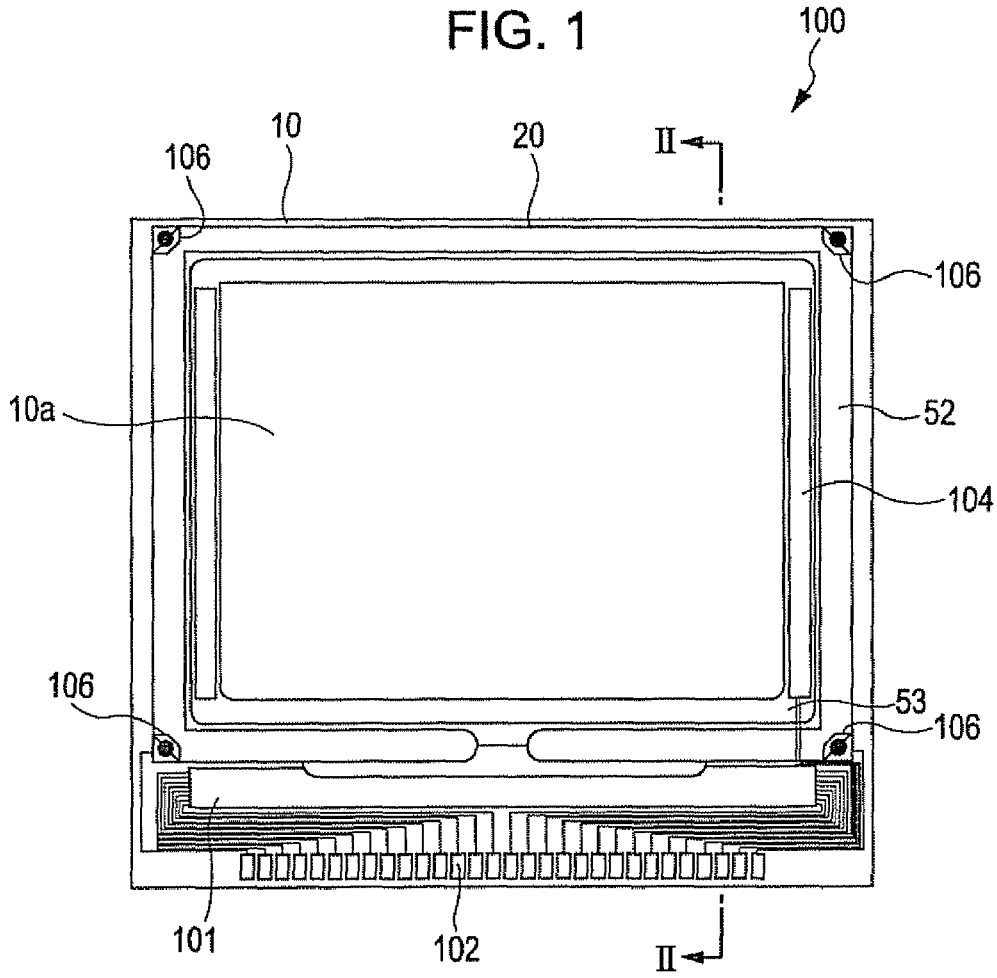
FIG. 1 is a plan view of a liquid crystal panel as an embodiment of an electro-optical device according to the invention.
Figure 2:
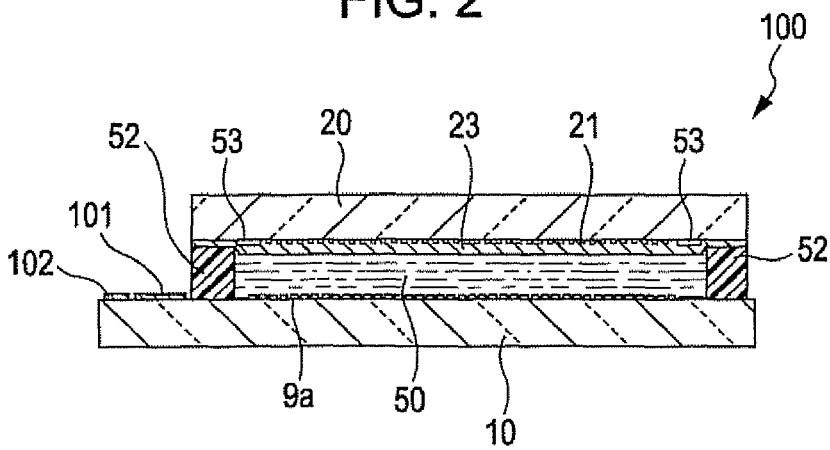
FIG. 2 is a sectional view taken along the line II-II of FIG. 1.

The overall configuration of a liquid crystal panel 100 as an embodiment of an electro-optical device according to the invention will be described with reference to FIGS. 1 and 2. FIG. 1 is a schematic plan view of a liquid crystal panel 100 serving as a TFT array substrate is viewed from a counter substrate side, together with the constituent elements formed thereon. FIG. 2 is a sectional view taken along the line II-II of FIG. 1. Here, a TFT active matrix driving type liquid crystal panel equipped with a driving circuit is exemplified.

Referring to FIGS. 1 and 2, in the liquid crystal panel 100 of this embodiment, a TFT array substrate 10 and a counter substrate 20 are disposed to be opposed to each other. A liquid crystal layer 50 is filled between the TFT array substrate 10 and the counter substrate 20. The TFT array substrate 10 and the counter substrate 20 are adhered to each other by a sealant 52, which is provided in a seal region at the periphery of an image display region 10*a* serving as an example of a 'display region' of the invention.

The sealant 52 is used to bond both substrates together and is formed of, for example, UV curable resin or thermosetting resin. The sealant 52 is coated on the TFT array substrate 10 during a manufacturing process and cured by means of UV irradiation or heating. In the sealant 52, a gap material, such as glass fibers or glass beads, is dispersed and is used to maintain an interval between the TFT array substrate 10 and the counter substrate 20 (a gap between the substrates) at a predetermined value.

Inside the seal region where the sealant 52 is disposed, a frame-shaped light-shielding film 53 for defining a frame-shaped region of the image display region 10*a* is provided on the counter substrate 20. A part of the frame-shaped light-shielding film 53 or the entire frame-shaped light-shielding film 53 may be provided as an internal light-shielding film on the TFT array substrate 10.

In a peripheral region at the periphery of the image display region 10*a*, in particular, a region outside of the seal region where the sealant 52 is disposed, a data line driving circuit 101 and an external circuit connection terminal 102 are provided along one side of the TFT array substrate 10. A scanning line driving circuit 104 is provided along one of two sides adjacent to the one side so as to be covered with the frame-shaped light-shielding film 53. Two scanning line driving circuits 104 may be provided along the two sides, respectively, adjacent to the one side of the TFT array substrate 10 where the data line driving circuit 101 and the external circuit connection terminal 102 are provided. In this case, the two scanning line driving circuits 104 are connected to each other by a plurality of wiring lines, which are provided along the remaining side of the TFT array substrate 10.

At four corners of the counter substrate 20, vertical connecting members 106 functioning as vertical connecting terminals between the two substrates are disposed. Meanwhile, in regions of the TFT array substrate 10 opposed to the corners, vertical connecting terminals are provided. With this structure, the TFT array substrate 10 and the counter substrate 20 can be electrically connected with each other.

Referring to FIG. 2, on the TFT array substrate 10, pixel electrodes 9*a* serving as an example of a 'driving electrode' of the invention are formed after pixel-switching TFTs and wiring lines, such as scanning lines and data lines, are formed. An alignment film is formed on the pixel electrodes 9*a*. Meanwhile, on the counter substrate 20, a counter electrode 21, a lattice or stripe-shaped light-shielding film 23, and an alignment film as an uppermost layer are formed. The liquid crystal layer 50 is formed of liquid crystal in which one or several kinds of nematic liquid crystal are mixed, and has a predetermined alignment state between the pair of alignment films.

Though not shown in FIGS. 1 and 2, in addition to the data line driving circuit 101 and the scanning line driving circuit 104, the TFT array substrate 10 is provided with a sampling circuit that samples image signals and supplies the sampled image signals to the data lines, and a correction signal supply circuit that supplies a correction signal to each pixel circuit, as described below. In this embodiment, in addition to the sampling circuit, a precharge circuit that supplies a precharge signal at a predetermined voltage level to a plurality of data lines before the image signals, and a test circuit that tests for defects and quality of the electro-optical device during manufacturing and at the time of shipping may be formed.

Electrical Configuration of Electro-Optical Device

Figure 3:
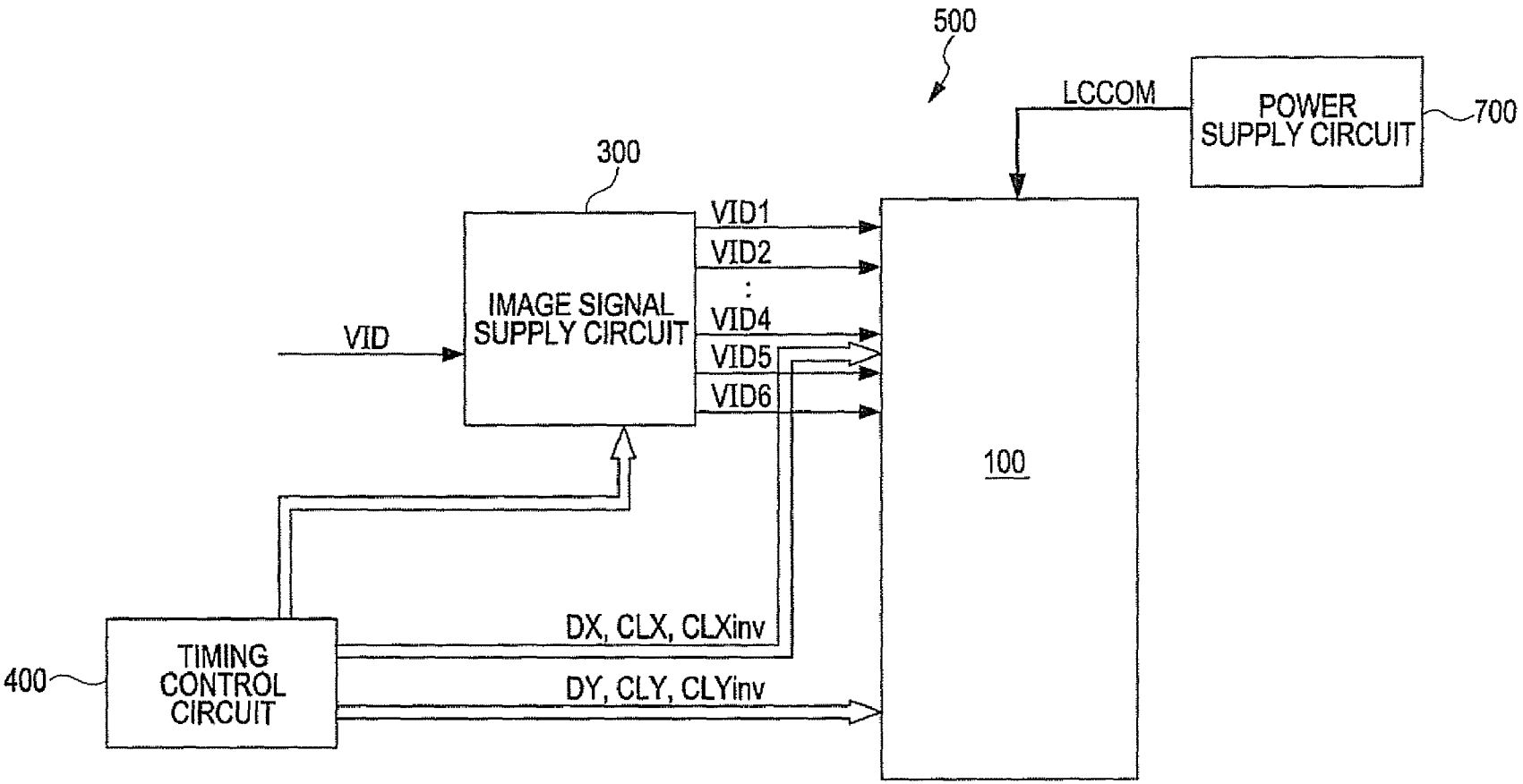
FIG. 3 is a block diagram showing the overall configuration of a liquid crystal panel as an embodiment of an electro-optical device according to the invention.
Figure 4:
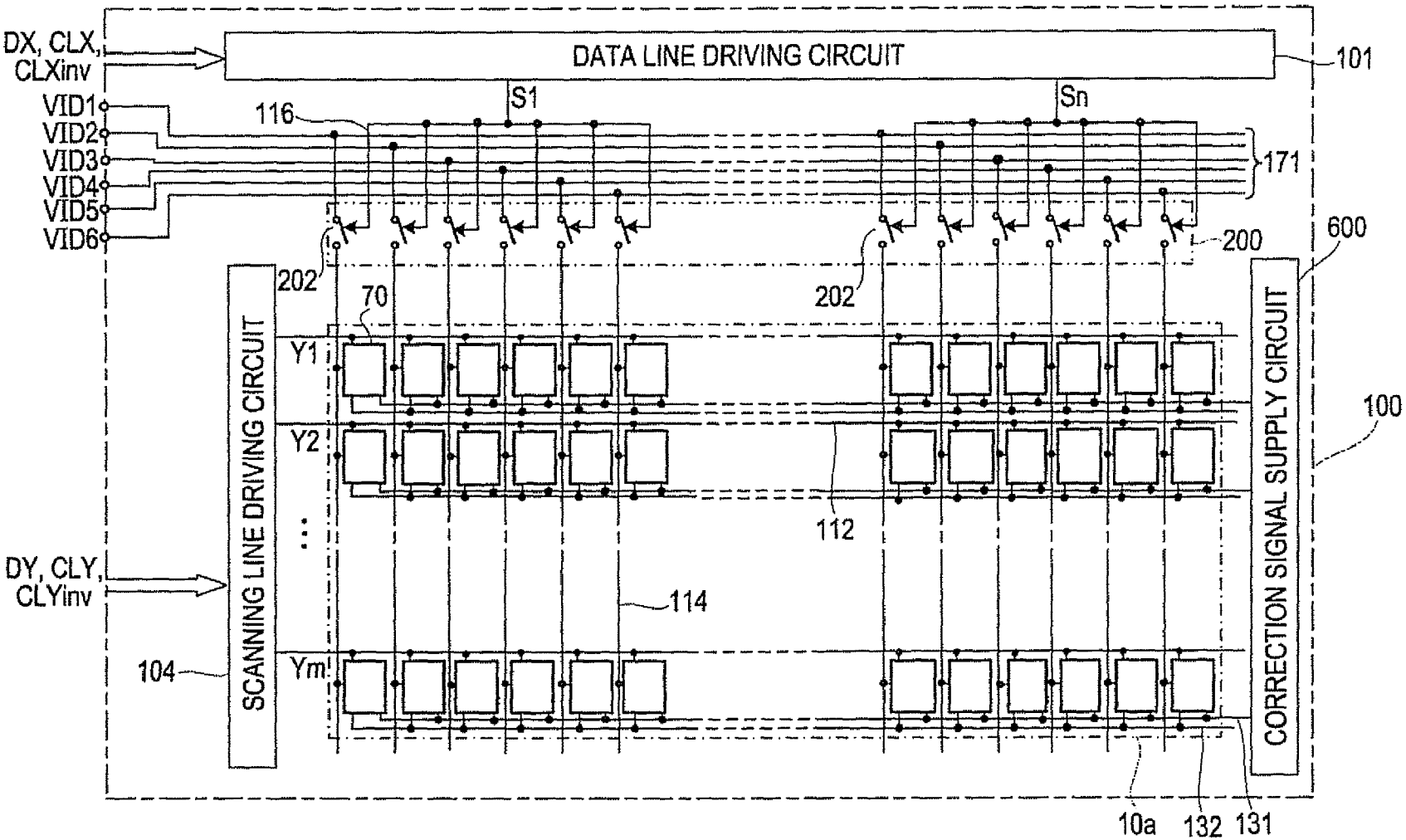
FIG. 4 is a block diagram showing the electrical configuration of a liquid crystal panel as an embodiment of an electro-optical device according to the invention.

Next, the electrical configuration of the liquid crystal panel 100 will be described with reference to FIGS. 3 and 4. FIG. 3 is a block diagram showing the overall configuration of a liquid crystal device including a liquid crystal panel. FIG. 4 is a block diagram showing the electrical configuration of the liquid crystal panel 100.

As shown in FIG. 3, a liquid crystal device 500 includes the liquid crystal panel 100, and an image signal supply circuit 300, a timing control circuit 400, and a power supply circuit 700, which are provided as external circuits.

The timing control circuit 400 is configured to output various timing signals that are used in the individual sections. A timing signal output unit which is a part of the timing control circuit 400 generates a dot clock for scanning the pixels as a minimum clock unit. On the basis of the dot clock, a Y clock signal CLY, an inverted Y clock signal CLYinv, an X clock signal CLX, an inverted X clock signal CLXinv, a Y start pulse DY, and an X start pulse DX are generated.

When the liquid crystal device 500 operates, that is, when the liquid crystal panel 100 operates, a series of input image data VID is input the image signal supply circuit 300 from the outside. The image signal supply circuit 300 performs serial-parallel conversion on the series of input image data VID, and generates N-phase (in this embodiment, six-phase (N=6)) image signals VID1 to VID6. The image signal supply circuit 300 inverts the polarities of the image signals VID1 to VID6 to positive and negative with respect to a predetermined reference potential, and outputs the polarity-inverted image signals VID1 to VID6.

The power supply circuit 700 supplies common power of a predetermined common potential LCCOM to the counter electrode 21 shown in FIG. 2. In this embodiment, the counter electrode 21 is formed at a lower part of the counter substrate 20 shown in FIG. 2 so as to be opposed to the plurality of pixel electrodes 9*a*.

As shown in FIG. 4, in the liquid crystal panel 100, the scanning line driving circuit 104, the data line driving circuit 101, the sampling circuit 200, and the correction signal supply circuit 600 are provided in the peripheral region of the TFT array substrate 10.

The scanning line driving circuit 104 is supplied with the Y clock signal CLY, the inverted Y clock signal CLYinv, and the Y start pulse DY. If the Y start pulse DY is input, the scanning line driving circuit 104 sequentially generates and outputs scanning signals Y1, . . . , and Ym at the timing based on the Y clock signal CLY and the inverted Y clock signal CLYinv.

The data line driving circuit 101 is supplied with the X clock signal CLX, the inverted X clock signal CLXinv, and the X start pulse DX. If the X start pulse DX is input, the data line driving circuit 101 sequentially generates sampling signals S1, . . . , and Sn at the timing based on the X clock signal CLX and the inverted X clock signal CLXinv, and outputs the sampling signals S1, . . . , and Sn to sampling switches 202 through wiring lines 116.

The sampling circuit 200 includes a plurality of sampling switches 202, each of which is constituted by a single-channel (P-channel or N-channel) type TFT or a complementary TFT.

The liquid crystal panel 100 further includes data lines 114 and scanning lines 112 arranged vertically and horizontally in the image display region 10*a* at the center portion of the TFT array substrate 10, and pixel circuits 70 in pixel portions corresponding to the intersections between the data lines 114 and the scanning lines 112. In this embodiment, the number of scanning lines 112 is m (where, m is a natural number of 2 or more), and the number of data lines 114 is n (where n is a natural number of 2 or more).

The image signals VID1 to VID6 subjected to six-phase serial-parallel development are supplied to the liquid crystal panel 100 through N (in this embodiment, six) image signal lines 171. As described below, the n data lines 114 are sequentially driven in groups of data lines, each group including six data lines 114 corresponding to the number of image signal lines 171.

The sampling signal Si (where i=1, 2, . . . , and n) is sequentially supplied to the sampling switches 202 corresponding to each group of data lines from the data line driving circuit 101, and the sampling switches 202 are turned on in accordance with the sampling signal Si. The sampling switch 202 is connected to the image signal line 171 through a relay line.

When the sampling switch 202 is turned on, that is, the sampling switch 202 is switched from the non-selection state to the selection state, the image signals VID1 to VID6 are simultaneously supplied to the data lines 114 belonging to each data line group from the six image signal lines 171 and sequentially supplied to the data line groups. Therefore, the data lines 114 belonging to a data line group are simultaneously driven. In this embodiment, the n data lines 114 can be driven in units of data line groups, and thus the driving frequency of the liquid crystal panel 100 can be suppressed, as compared with a case in which phase development is not performed.

The liquid crystal panel 100 includes correction signal lines 131 and fixed potential lines 132.

The correction signal lines 131 electrically connect the correction signal supply circuit 600 and the pixel circuits 70. As described below, the correction signal output from the correction signal supply circuit 600 are supplied to the pixel circuits 70 through the correction signal lines 131.

In this embodiment, the correction signal line 131 is provided for each row of a plurality of pixel circuits 70 arranged in a matrix, but it may be electrically connected to two adjacent pixel circuits along an extension direction of the data lines 114 among the plurality of pixel circuits 70. That is, the correction signal described below may be supplied to the two pixel circuits through a correction signal line common to the two pixel circuits. As such, if adjacent pixel circuits share a correction signal line, the number of correction signal lines can be reduced, as compared with a case in which a correction signal line is provided for each row of the scanning lines 112.

The correction signal line 131 that is electrically connected to one pixel circuit 70 may include a plurality of wiring lines. With the plurality of wiring lines, the correction signal may be divided into a plurality of auxiliary correction signals and then supplied to the pixel circuit 70. Therefore, when the correction signal is supplied, a load on a single wiring line can be reduced.

The fixed potential lines 132 supply to the pixel circuits 70 a common potential LCCOM, which is supplied from an external circuit, serving as an example of a 'fixed potential' of the invention.

Configuration and Operation of Pixel Circuit

Figure 5:
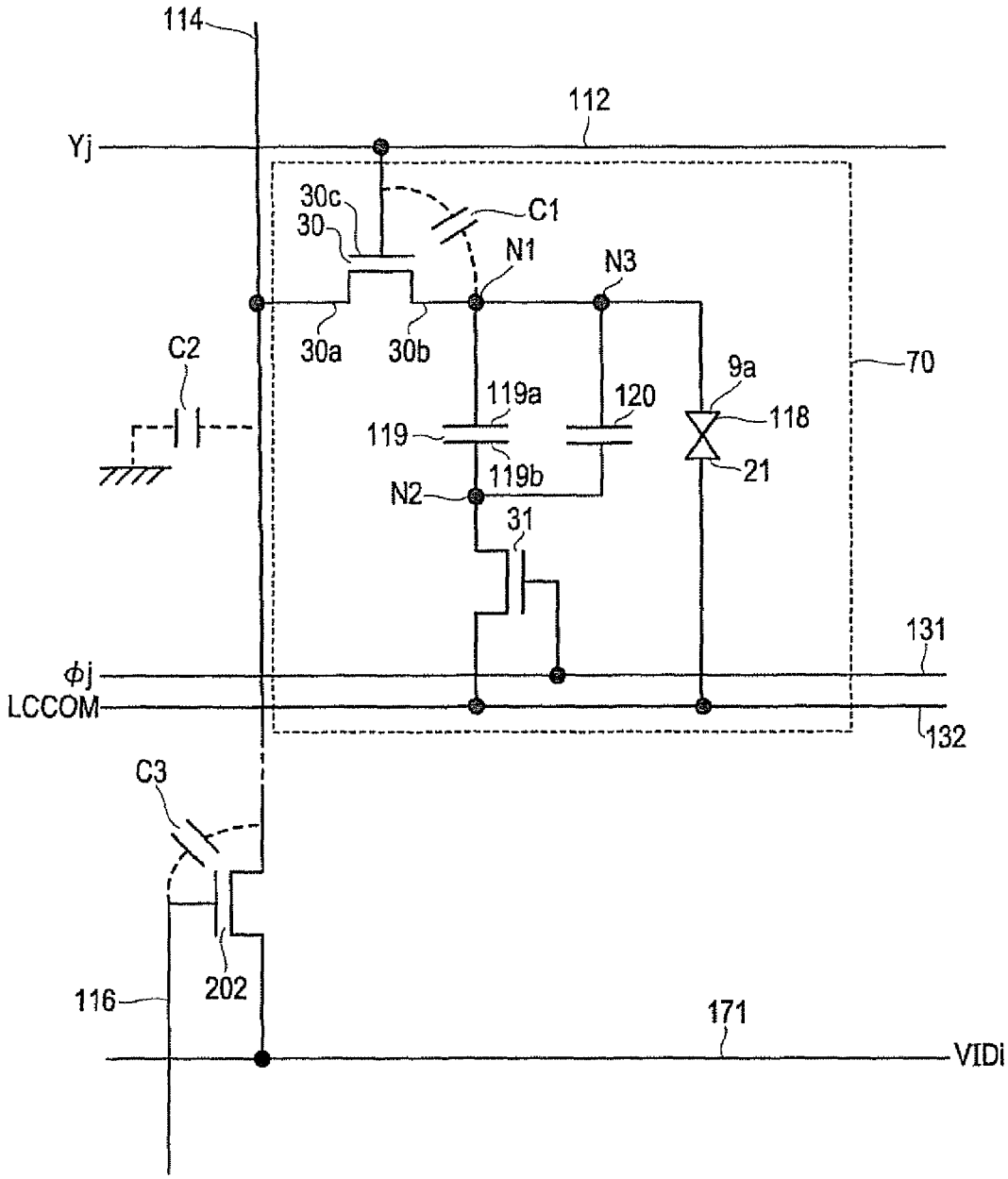
FIG. 5 is a circuit diagram showing the configuration of a pixel circuit in a liquid crystal panel as an embodiment of an electro-optical device according to the invention, together with a sampling switch.
Figure 6A:
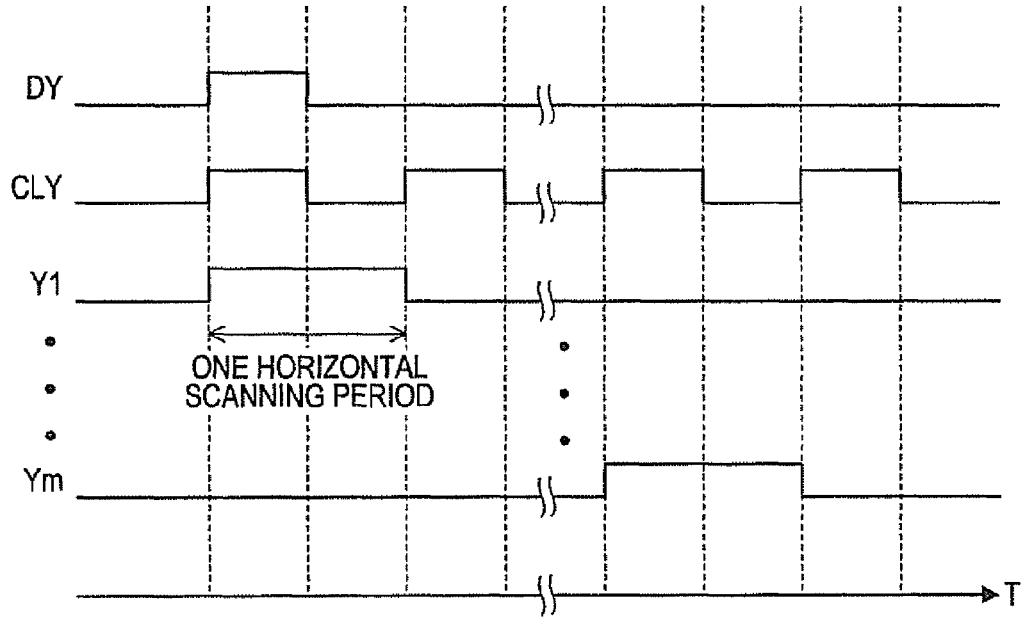
FIGS. 6A and 6B are timing charts (first one) of various signals to be supplied to a liquid crystal panel as an embodiment of an electro-optical device according to the invention.
Figure 6B:
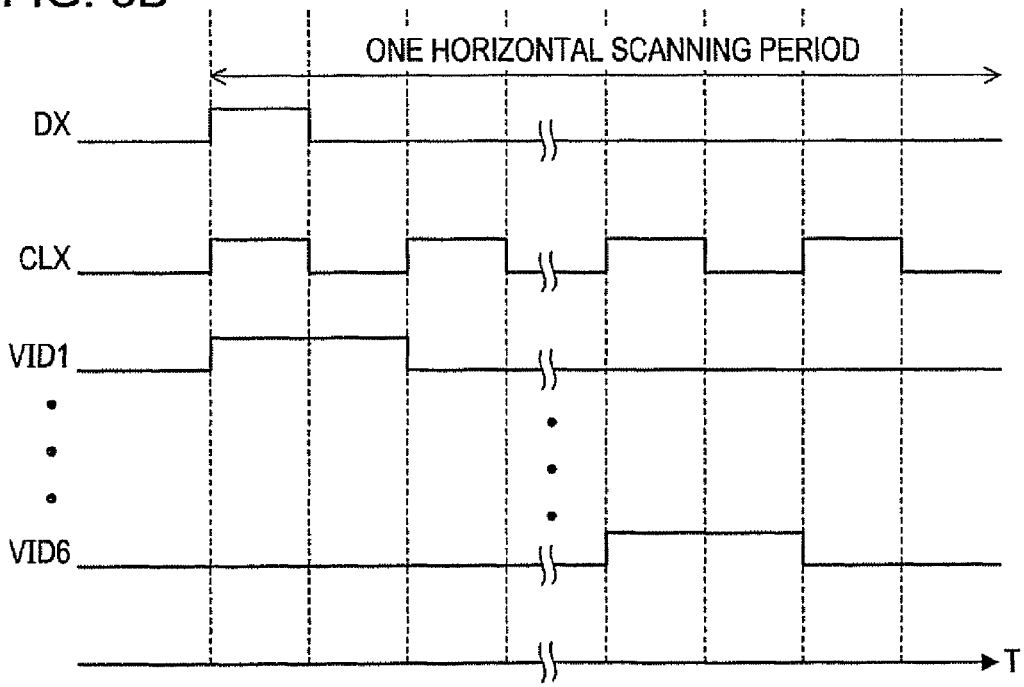
Figure 7:
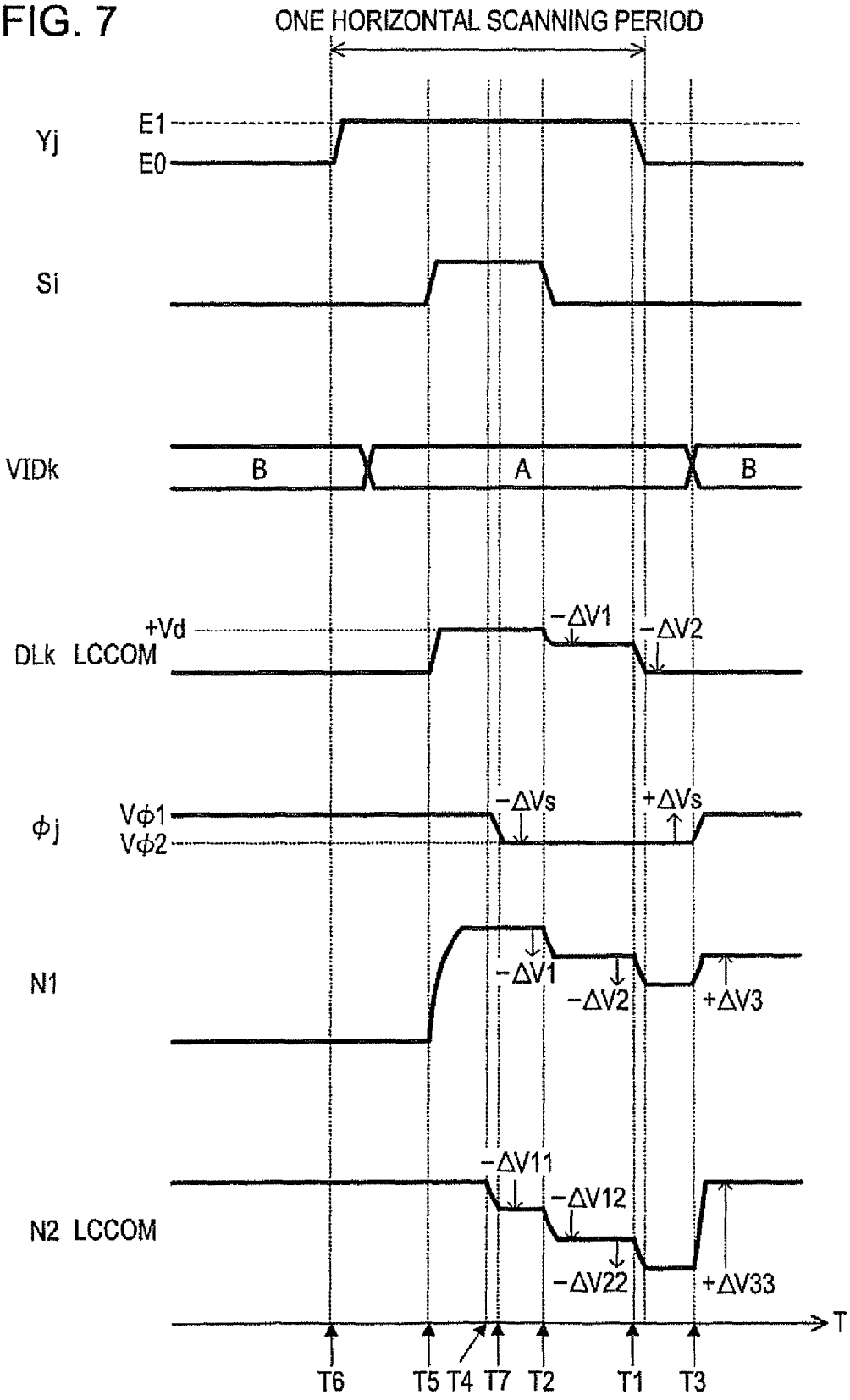
FIG. 7 is a timing chart (second one) of various signals to be supplied to a liquid crystal panel as an embodiment of an electro-optical device according to the invention.
Figure 8:
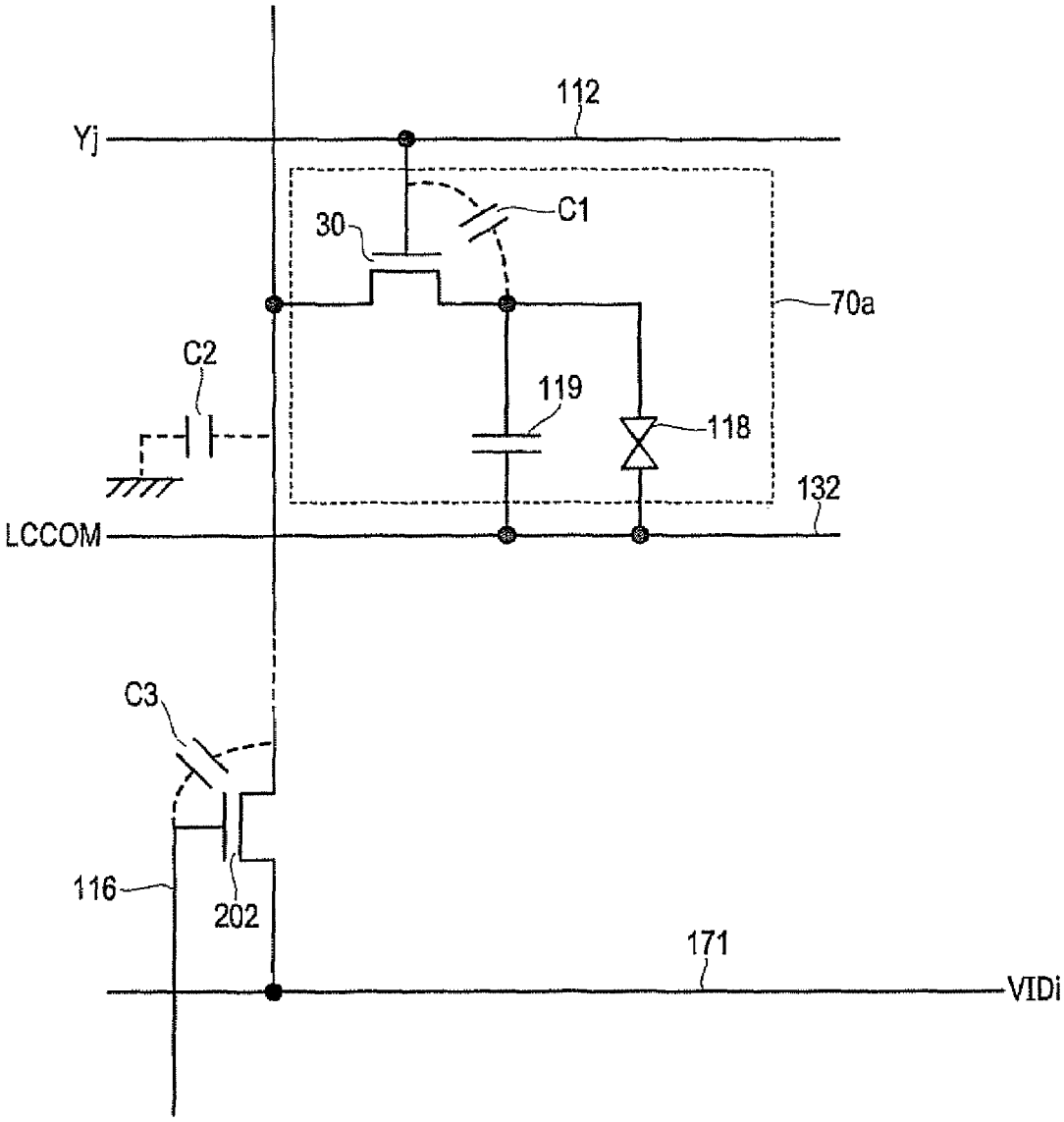
FIG. 8 is a circuit diagram of a pixel circuit according to a comparative example with respect to a pixel circuit in a liquid crystal panel as an embodiment of an electro-optical device according to the invention.
Figure 9:
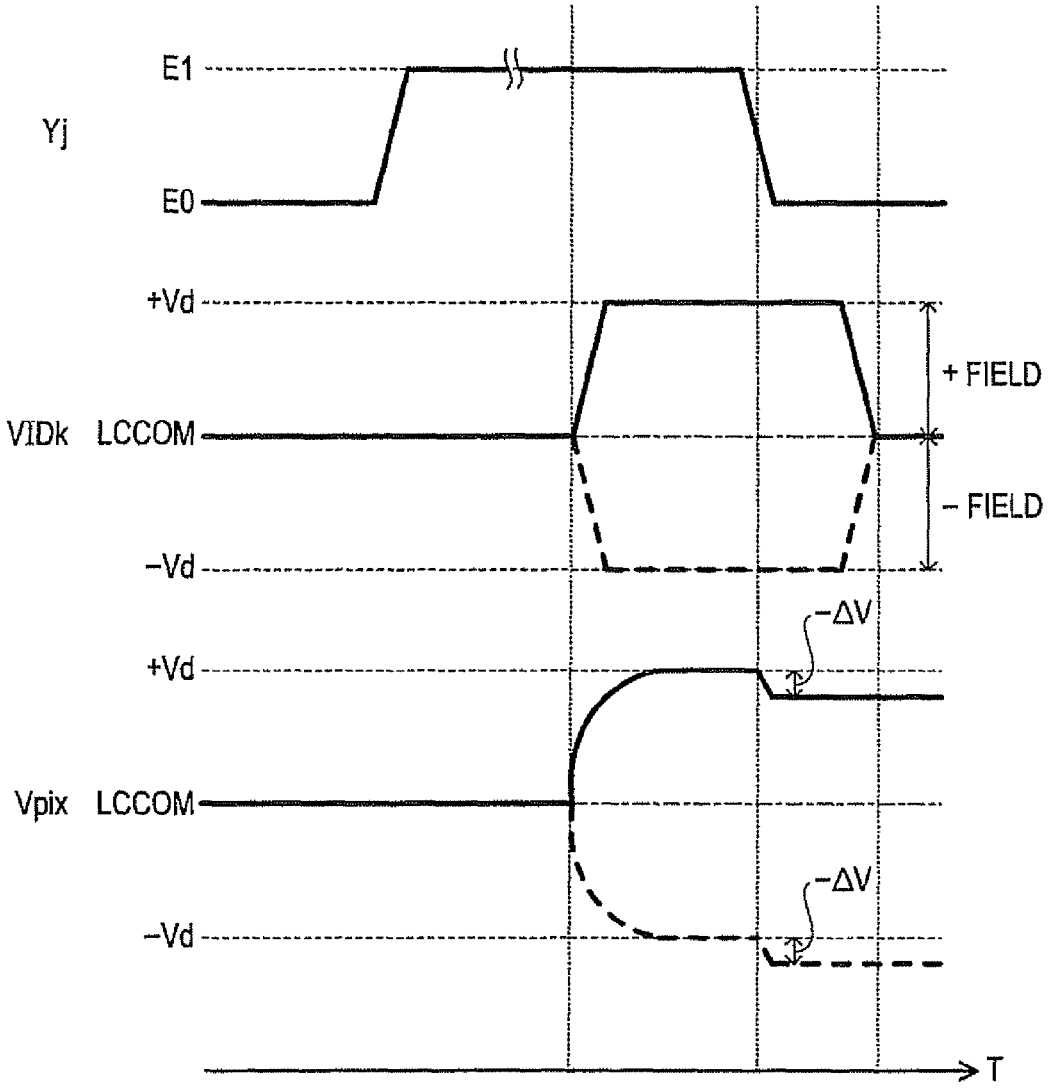
FIG. 9 is a timing chart of various signals to be supplied to a pixel circuit according to a comparative example with respect to a pixel circuit in a liquid crystal panel as an embodiment of an electro-optical device according to the invention.
Figure 10:
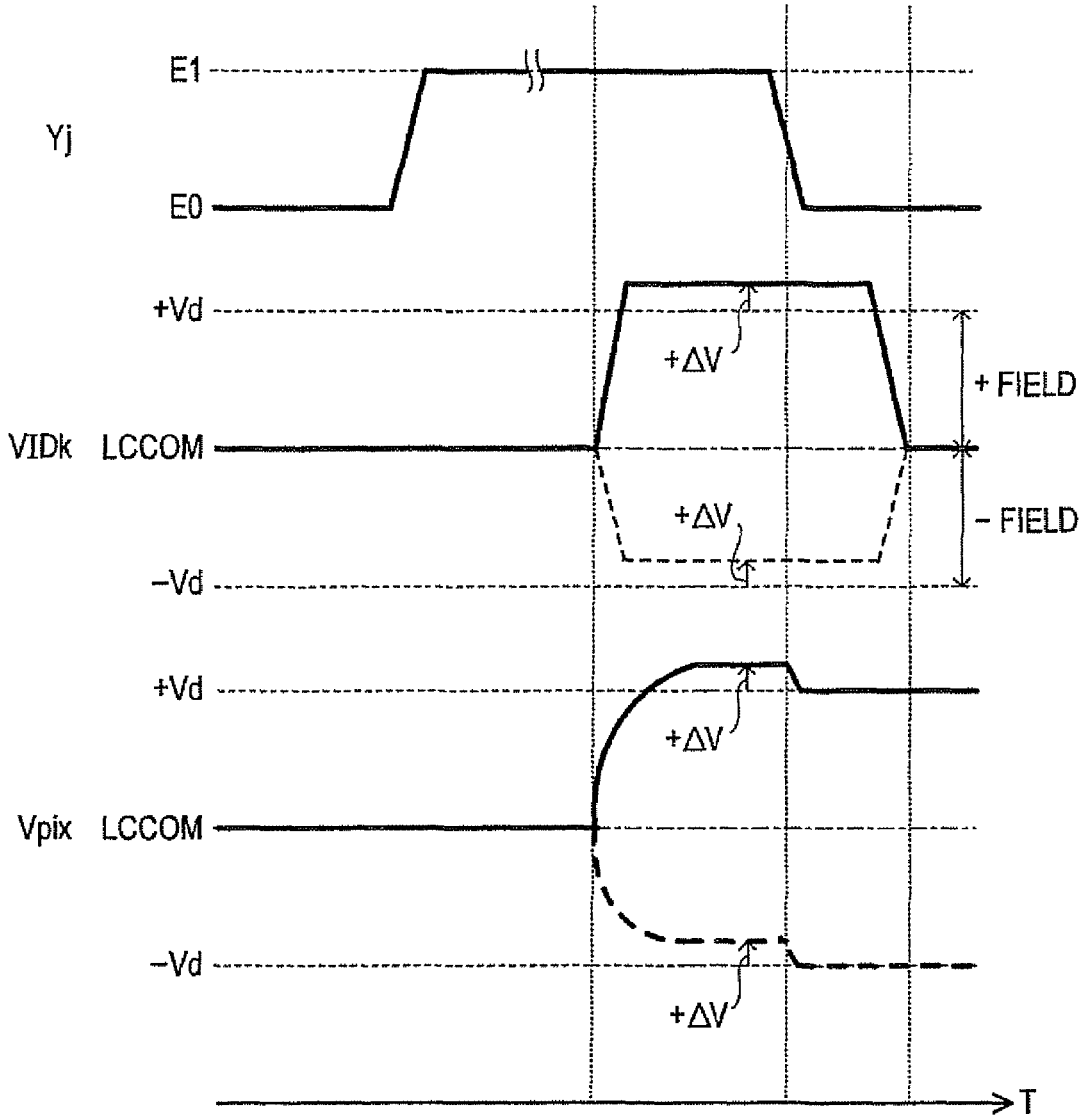
FIG. 10 is another timing chart of various signals to be supplied to a pixel circuit according to a comparative example with respect to a pixel circuit in a liquid crystal panel as an embodiment of an electro-optical device according to the invention.

Next, the electrical configuration and operation of the pixel circuit 70 will be described with reference to FIGS. 5 to 10. FIG. 5 is a circuit diagram showing the configuration of the pixel circuit 70 according to this embodiment, together with the sampling switch 202. FIGS. 6A and 6B, and FIG. 7 are timing charts of various signals to be supplied to the liquid crystal panel according to this embodiment. FIG. 8 is a circuit diagram of a pixel circuit according to a comparative example with respect to the pixel circuit in the liquid crystal panel according to this embodiment. FIG. 9 is a timing chart of various signals to be supplied to the pixel circuit shown in FIG. 8. FIG. 10 is another timing chart of various signals to be supplied to a pixel circuit according to a comparative example.

As shown in FIG. 5, the pixel circuit 70 includes a liquid crystal element 118 serving as an example of a 'display element' of the invention, a pixel electrode 9*a*, a TFT 30 serving as an example of a 'driving transistor element' of the invention, nodes N1 and N2, a storage capacitor 119, a TFT 31 serving as an example of a 'switching unit' of the invention, and a capacitive element 120 serving as an example of a 'capacitance unit' of the invention.

When the liquid crystal panel 100 operates, the liquid crystal element 118 is configured such that the alignment state of liquid crystal is controlled by a voltage between the pixel electrode 9*a* and the counter electrode 21 opposed to the pixel electrode 9*a*. Then, light is emitted toward a display surface of the liquid crystal panel 100 in accordance with the alignment state.

The TFT 30 has a source electrode 30*a* serving as an example of an 'input terminal' of the invention, a drain electrode 30*b* serving as an example of an 'output terminal' of the invention, and a gate electrode 30*c*. When the liquid crystal panel 100 operates, the TFT 30 controls driving of the liquid crystal element 118 through the pixel electrode 9*a*. Specifically, as shown in FIGS. 4 and 5, the source electrode 30*a* of the TFT 30 is electrically connected to the data line 114 to which the image signal VIDk (where k=1, 2, 3, . . . , and 6) is supplied. The gate electrode 30*c* of the TFT 30 is electrically connected to the scanning line 112 to which the scanning signal Yj (where j=1, 2, 3, . . . , and m) is supplied, and the drain electrode 30*b* of the TFT 30 is connected to the pixel electrode 9*a* of the liquid crystal element 118.

The source electrode 30*a* and the drain electrode 30*b* are electrically connected to a source region and a drain region in an active region constituting a part of the TFT 30, respectively. In this embodiment, as an active matrix driving method that drives the liquid crystal panel 100, an inversion driving method in which the polarity of the image signal is inverted is used. Therefore, the potentials of the source region and the drain region, which are electrically connected to the source electrode 30*a* and the drain electrode 30*b*, respectively, are switched with each other depending on the polarity of the image signal. Specifically, when the TFT 30 is an N-channel type TFT, and a positive-polarity image signal is supplied to the source electrode 30*a*, the source electrode 30*a* is at a potential higher than the drain electrode 30*b*. When a negative-polarity image signal is supplied to the source electrode 30*a*, the source electrode 30*a* is at a potential lower than that of the drain electrode 30*b*, and function as a drain electrode. In the pixel circuit 70, the liquid crystal element 118 includes the pixel electrode 9*a* and the counter electrode 21 with liquid crystal interposed therebetween.

In the pixel circuit 70 corresponding to the scanning line 112 to which the scanning signal Yj is supplied, that is, the pixel circuit 70 corresponding to the selected scanning line 112, if the scanning signal Yj is supplied to the TFT 30, the TFT 30 is turned on (that is, switched from the non-selection state to the selection state), and the pixel circuit 70 is put in a selection state. While the TFT 30 is in the selection state during a predetermined period, the image signal VIDk is supplied to the pixel electrode 9*a* of the liquid crystal element 118 from the data line 114 at a predetermined timing.

Accordingly, an application voltage defined by a difference in potential between the pixel electrode 9*a* and the counter electrode 21 is applied to the liquid crystal element 118. The alignment or order of molecules of liquid crystal is changed in accordance with the application voltage, such that gray-scale display can be performed by light modulation. In a normally white mode, transmittance of incident light decreases in accordance with the application voltage to each pixel. In a normally black mode, transmittance of incident light increases in accordance with the application voltage to each pixel. As a whole, light having contrast according to the image signals VID1 to VID6 is emitted from the liquid crystal panel 100.

As shown in FIG. 5, the storage capacitor 119 includes a first capacitor electrode 119*a*, a second capacitor electrode 119*b*, and a dielectric layer (not shown) interposed between the capacitor electrodes. The storage capacitor 119 has a laminate structure in which a dielectric layer, which is a part of an interlayer insulating film formed on the TFT array substrate 10, is interposed between the first capacitor electrode 119*a* and the second capacitor electrode 119*b* serving as a pair of capacitor electrodes.

The first capacitor electrode 119*a* is electrically connected to the drain electrode 30*b* of the TFT 30. The second capacitor electrode 119*b* is electrically connected to the TFT 31. The storage capacitor 119 is electrically connected in parallel to the liquid crystal element 118 on the drain electrode 30*b* side. When the liquid crystal panel 100 operates, the storage capacitor 119 maintains the potential of the pixel electrode 9*a* set according to the image signal VIDk. In order to prevent leakage of the image signal maintained in the pixel electrode 9*a*, the potential of the pixel electrode 9*a* is maintained by the storage capacitor 119 for a period of time, for example, three digits longer than the time of application of a source voltage. Therefore, a property for maintaining the potential of the pixel electrode 9*a* is improved, and thus a high contrast ratio is achieved.

However, due to capacitance C1 between the gate and drain of the TFT 30 when the TFT 30 operates, capacitance C2 between the data line 114 and the ground, or capacitance C3 between the gate and drain of the sampling switch 202 when the sampling switch 202 is switched from the selection state to the non-selection state, the potential of the pixel electrode 9*a*, that is, the potential of a node N1 in a connection path electrically connecting the pixel electrode 9*a* and the drain electrode 30*b* is lowered by a pushdown phenomenon. For this reason, display performance of the liquid crystal panel 100 is deteriorated.

Accordingly, as described below, the pixel circuit 70 switches an electrical connection state between the storage capacitor 119 and the fixed potential line 132 by the TFT 31, to thereby compensate for a change in the potential of the node N1, that is, the potential of the pixel electrode 9*a*. Thus, display performance of the liquid crystal panel 100 is improved.

The TFT 31 is a switching transistor element that switches the electrical connection state between the second capacitor electrode 119*b* and the fixed potential line 132 in accordance with a correction signal ϕj. The TFT 31 and the TFT 30 preferably are of the same conduction type. Specifically, in this embodiment, the TFTs 30 and 31 are n-channel type TFTs. The TFTs 30 and 31 are formed in parallel by doping a common impurity into a semiconductor layer formed on the TFT array substrate 10 by using a common semiconductor manufacturing process in the manufacturing process of the liquid crystal panel 100, that is, by means of a common implantation process. Since the elements can be formed by means of the common implantation process, an interval between the elements can be narrowed, as compared with a case in which different impurities are doped in the semiconductor layer. What is necessary is that the active layers of the elements formed by means of the implantation process are of the same conduction type. Therefore, even if the regions on the substrate where the TFTs 30 and 31 are to be formed are set close to each other, there is no case in which the active layers being of different conduction types are formed, and the TFTs 30 and 31 being of the conduction types as designed can be formed. The TFTs 30 and 31 may be p-channel type transistors. In this case, similarly to the n-channel type, the interval between the elements can be narrowed.

According to the liquid crystal panel 100, since the interval between the TFTS 30 and 31 on the TFT array substrate 10 can be narrowed, the pixel circuit 70 can be reduced in size. Therefore, according to the liquid crystal panel 100, the pitch of the pixel on the TFT array substrate 10 can be made fine, and as described below, high definition of an image to be displayed on the image display region 10*a* can be achieved. In addition, according to the liquid crystal panel 100, the conduction types of the TFTs 30 and 31 may be selected depending on the polarities of the scanning signal and the correction signal.

Similarly to the storage capacitor 119, the capacitive element 120 is electrically connected in parallel to the liquid crystal element 118 on the drain electrode 30*b* side. Specifically, the capacitive element 120 is electrically connected between nodes N2 and N3. The node N2 is provided in a connection path electrically connecting the second capacitor electrode 119*b* and the TFT 31. The node N3 is provided in a connection path electrically connecting the drain electrode 30*b* and the pixel electrode 9*a*. The capacitive element 120 has capacitance higher than that of the storage capacitor 119, by switching of the TFT 31 between the selection state and the non-selection state, compensates for a change in the potential of the pixel electrode 9*a*, together with the storage capacitor 119. In particular, when the storage capacitor 119 does not have capacitance enough to maintain the potential of the pixel electrode 9*a*, the capacitive element 120 is effectively used in maintaining the electrode potential.

The electro-optical device according to the invention is not limited to a liquid crystal device that displays an image by using a modulation element, such as a liquid crystal element, which emits display light by light modulation. For example, the electro-optical device may be a display device that includes a pixel circuit having a display element, for example, a self-luminous element, such as an EL element. In such a display device, an electrode for supplying a driving current to a light-emitting layer is an example of the driving electrode. In this case, the lowering of the electrode potential due to the pushdown phenomenon is compensated in the same manner as the liquid crystal panel 100.

Next, the operation of the pixel circuit 70 will be described with reference to FIGS. 5 to 7.

As shown in FIGS. 5 and 6A, the scanning signals Y1, . . . , and Ym are sequentially supplied to the scanning lines 112 in accordance with the Y clock signal CLY and the Y start pulse DY supplied to the liquid crystal panel 100. As shown in FIGS. 5 and 6B, the image signals VID1, . . . , and VID6 are supplied to the sampling circuit 200 through the image signal lines 117 in accordance with the X start pulse DX and the X clock signal CLX supplied to the data line driving circuit 101 during one horizontal scanning period. A plurality of sampling switches 202 constituting the sampling circuit 200 are switched from the off state (that is, the non-selection state) to the on state (that is, the selection state) in accordance with the sampling signals Si, which are output from the data line driving circuit 101 in accordance with the X clock signal CLX, and supply the image signals VID1, . . . , and VID6 to the data lines 114 corresponding to the image signals.

The generation process of the pushdown phenomenon in which the potential of the pixel electrode 9*a*, that is, the potential of the node N is lowered will be described with reference to FIGS. 8 to 10, together with the operation of a pixel circuit in a liquid crystal panel according to a comparative example with respect to the liquid crystal panel according to this embodiment. In the following description, the same parts as those in the liquid crystal panel according to this embodiment are represented by the same reference numerals, and descriptions thereof will be omitted.

As shown in FIG. 8, the electrical configuration of a pixel circuit 70*a* in a liquid crystal panel according to a comparative example is different from that of the pixel circuit 70 in that the TFT 31, the capacitive element 120, and the correction signal line 131 are not provided.

As shown in FIG. 9, after the scanning signal Yj is supplied to the scanning line 112, that is, after the potential of the scanning line 112 rises from a potential E0 to a potential E1 in accordance with the supply of the scanning signal Yj, the image signal VIDk is supplied to the data line 114. The image signal VIDk is supplied while the polarity is inverted to positive or negative with respect to the common potential LCCOM or a fixed potential VCOM different from the common potential LCCOM for every predetermined period, for example, one field period. In FIG. 9, the positive-polarity image signal VIDk is at a potential higher by a potential Vd than the common potential LCCOM, and the negative-polarity image signal VIDk is at a potential lower by a potential Vd than the common potential LCCOM.

If the image signal VIDk has a positive polarity, when the sampling switch 202 is switched from the non-selection state to the selection state, the potential of the node N1, that is, the electrode potential Vpix of the pixel electrode 9*a* rises to a potential +Vd higher than the common potential LCCOM.

However, when the TFT 30 is switched from the non-selection state to the selection state, the electrode potential Vpix of the pixel electrode 9*a* is lowered by a potential ΔV due to capacitance C1 between the gate and the drain of the TFT 30. The lowering of the electrode potential Vpix occurs whichever of the positive-polarity image signal VIDk and the negative-polarity image signal VIDk is supplied.

Here, as shown in FIG. 10, in order to reduce a change ΔV in the electrode potential Vpix, a method that compensates for a variation of the electrode potential Vpix by setting the potential of the image signal VIDk to be higher by ΔV than a target potential +Vd or −Vd in advance may be considered.

In this case, however, it is necessary to control the potential of the image signal, which is supplied to the liquid crystal panel outside of the liquid crystal panel, by using an external circuit, such as the image signal supply circuit 300, and to change design of the external circuit. In addition, it is necessary to increase a gate voltage of the TFT 30 for supplying the image signal VIDk at a high potential to the pixel electrode 9*a*. Accordingly, voltage resistance of the scanning lines 112 needs to be increased, and as for design of the liquid crystal panel, portions to be changed are increased.

Therefore, as described in detail with reference to FIGS. 5 and 7, the TFT 31 in the liquid crystal panel 100 of this embodiment is switched at a predetermined timing, such that a change in the potential of the node N1, that is, the potential Vpix of the pixel electrode 9*a*, is compensated.

Specifically, referring to FIGS. 5 and 7, if the sampling signal Si is supplied to the sampling switch 202 during one horizontal scanning period in which the scanning signal Yj is supplied, the image signal VIDk is sampled to the data line 114 corresponding to the image signal VIDk, and the potential DLk of the data line 114 is raised. In FIG. 7, a period in which the positive-polarity image signal VIDk is supplied is represented by A, and a period in which the negative-polarity image signal VIDk is supplied is represented by B. In this embodiment, for simplification of explanation, the operation of the pixel circuit 70 will be described in connection with the period in which the positive-polarity image signal VIDk is supplied. Therefore, in FIG. 7, the image signal VIDk sampled according to the sampling signal Si has a positive polarity, and the potential DLk of the data line 114 to which the image signal VIDk is supplied is increased at a potential Vd higher than the common potential LCCOM.

The TFT 31 is electrically connected to the fixed potential line 132, to which the common potential LCCOM is supplied, and the second capacitor electrode 119*b*, and switches the electrical connection state between the fixed potential line 132 and the second capacitor electrode 119*b* in accordance with the correction signal ϕj. Specifically, the gate of the TFT 31 is electrically connected to the correction signal line 131, and the correction signal supply circuit 600 decreases the correction signal ϕj from a potential Vϕ1 to a potential Vϕ2 by a voltage ΔVs at a time T4. The potential Vϕ1 or Vϕ2 is an example of a 'predetermined potential' in the invention.

After a time T6 at which the TFT 30 is switched from the non-selection state to the selection state, the TFT 31 switches the connection state between the fixed potential line 132 and the second capacitor electrode 119*b* from the conduction state to the non-conduction state before a time T1 serving as an example of a 'first time' of the invention, at which the TFT 30 is to be switched from the selection state to the non-selection state again. Then, at a time T3 after the time T1, the TFT 31 switches the connection state between the fixed potential line 132 and the second capacitor electrode 119*b* from the non-conduction state to the conduction state.

Therefore, when the liquid crystal panel 100 operates, before the time T1, the node N2 in the connection path between the TFT 31 and the storage capacitor 119 is electrically isolated from the fixed potential line 132. At this time, the node N2 is put in a floating state.

The potential Vϕ1 of the correction signal ϕ is preferably the same as the potential of the scanning signal Yj to be supplied to the gate electrode 30*c*. By supplying the correction signal ϕ at the potential Vϕ1, the potential of the second capacitor electrode 119*b*, that is, the potential of the node N2 can be set to be same as the common potential.

In addition, a difference between the potential Vϕ2 of the correction signal ϕ and the common potential LCCOM is preferably the same as a threshold voltage Vth of the TFT 31. With the potential Vϕ2, when the TFT 31 is switched from the non-selection state (that is, the off state) to the selection state (that is, the on state), the potential of the correction signal ϕ is input to the gate of the TFT 31 as a signal at a higher potential by the threshold voltage Vth than the common potential LCCOM. Therefore, an on/off operation to switch conduction and non-conduction of the channel region of the TFT 31 can be accurately performed, and when the TFT 31 is selected, the potential of the second capacitor electrode 119*b* can be rapidly and accurately set to the common potential LCCOM.

At the time T1, when the TFT 30 is switched from the selection state to the non-selection state, capacitance coupling C1 is produced between the gate and drain of the TFT 30, and the potential of the pixel electrode 9*a*, that is, the potential of the node N1 is lowered by a voltage ΔV2 due to capacitance coupling C1. Therefore, even if the image signal VIDk is supplied to the pixel electrode 9*a* through the data line 114 and the TFT 30 during a period in which the TFT 30 is in the selection state (that is, one horizontal scanning period in the drawing), it is difficult to maintain the potential of the pixel electrode 9*a* at a potential according to the image signal VIDk.

Thus, at the time T3 after the time T1, the TFT 31 switches the electrical connection state between the second capacitor electrode 119*b* and the fixed potential line 132 from the non-conduction state to the conduction state. Therefore, the voltage ΔV2 corresponding to the change in the potential of the node N1, that is, the potential of the pixel electrode 9*a* is transmitted to the node N2, and the potential of the node N1 is raised by a voltage ΔV3.

Specifically, during a period from a time T7, at which the connection state between the fixed potential line 132 and the second capacitor electrode 119*b* is the non-conduction state, to the time T3, that is, a period in which the correction signal ϕj is at the potential Vϕ2, the potential of the node N2 is different from the common potential LCCOM. At the time T3, if the connection state between the second capacitor electrode 119*b* and the fixed potential line 132 is switched from the non-conduction state to the conduction state, the potential of the node N2 becomes the same as the common potential LCCOM. A change in the potential of the node N2 causes a change in the amount of electric charge accumulated in the storage capacitor 119. The change in the amount of electric charge accumulated in the storage capacitor 119 is accompanied by an increase in the potential of the node N1 by the voltage ΔV3. The increase in the potential of the node N1 makes it possible to compensate for the lowering of the potential of the pixel electrode 9*a* due to the pushdown phenomenon.

Therefore, according to the liquid crystal panel 100, when the electrical connection state between the second capacitor electrode 119*b* and the fixed potential line 132 is the non-conduction state, specifically, during the period from the time T7, at which the node N2 is electrically isolated from the fixed potential line 132 and in the floating state, to the time T3, a change in the potential of the drain electrode 30*b* and the node N1, which are at the same potential, causes a change in the potential of the node N2 by capacitance coupling in the storage capacitor 119. In this state, at the time T3 after the time T1, by switching the connection state between the second capacitor electrode 119*b* and the fixed potential line 132 from the non-conduction state to the conduction state, the potential of the node N2 can be approximated to the common potential LCCON. In addition, according to the change in the potential of the node N2, that is, an increase of a voltage ΔV33, the potential of the node N1, that is, the potential of the pixel electrode 9*a* can be compensated by means of the storage capacitor 119.

When it is assumed that no capacitive element 120 is provided, the relationship between the voltages ΔV1, ΔV2, ΔV3, ΔV11, ΔV12, ΔV22, and ΔV33, which are the changes in potential of the nodes N1 and N2 shown in FIG. 7, parasitic capacitance C1, C2, C3, C4, C5, and C6, which are produced in the TFT 30, the data line 114, the sampling switch 202, the storage capacitor 119, the TFT 31, and the liquid crystal element 118, respectively, and the potential Vsi of the sampling signal Si, the potential VDL of the data line 114, the potential VT1 of the scanning signal, and the potential Vϕj of the correction signal ϕj are represented by Equations 1 to 7.

$$\Delta V1 = Vsi \times C3/(C3+Cd2) \quad \text{Equation 1}$$

$$\Delta V2 = VDL + VT1 \times C1/(C1+C4+C6) \quad \text{Equation 2}$$

$$\Delta V3 \cong \Delta V2 \quad \text{Equation 3}$$

$$\Delta V11 = V\phi j \times C5/(C5+C4) \quad \text{Equation 4}$$

$$\Delta V12 \cong \Delta V1 \quad \text{Equation 5}$$

$$\Delta V22 \cong \Delta V2 \quad \text{Equation 6}$$

$$\Delta V33 \cong \Delta V11 + \Delta V12 + \Delta V22 \quad \text{Equation 7}$$

As such, according to the liquid crystal panel 100, the change in the potential of the pixel electrode 9*a* can be compensated, without needing an image signal at a prescribed potential in order to compensate for the change in the potential of the pixel electrode 9*a*, and occurrence of insufficient writing of the image signal VIDk to the pixel electrode can be suppressed. In addition, even if the potential of the data line 114 is changed while the TFT 30 is being selected, it is possible to suppress the change in the potential of the pixel electrode 9*a* due to the change in the potential of the data line 114. Therefore, the change in the potential of the data line 114 due to capacitance coupling between the data lines or the data lines and other wiring lines can be prevented from being transmitted to the pixel electrode 9*a*.

According to the liquid crystal panel 100, the change in the potential of the pixel electrode 9*a* when the TFT 30 is switched from the selection state to the non-selection state, specifically, the lowering of the potential due to the pushdown phenomenon can be suppressed, and the potential of the pixel electrode 9*a* can be maintained (that is, held) at a potential according to the potential of the image signal VIDk. Therefore, defective display due to the change in the potential of the pixel electrode 9*a* can be reduced. In particular, when the image signal VIDk is in forms of an analog signal, the alignment state of liquid crystal in the liquid crystal element 118 is determined in advance by a V-T curve, which defines the relationship between the voltage V applied to liquid crystal and a time T for which the voltage V is maintained. Therefore, if the potential of the pixel electrode can be maintained (that is, held) for a longer time, a variation in luminance of the pixel with respect to the target luminance can be effectively suppressed, and display performance of the liquid crystal panel 100 can be increased.

In addition, according to the liquid crystal panel 100, immediately after the time T1 at which the TFT 30 is switched from the selection state to the non-selection state, the electrical connection state between the second capacitor electrode 119*b* and the fixed potential line 132 can be switched from the non-conduction state to the conduction state. Therefore, a precharge period in which the data line 114 is precharged can be ensured.

As shown in FIG. 7, at the time T4 during a period from the time T5 to the time T2, the TFT 31 is switched from the selection state to the non-selection state in accordance with a change in the potential of the correction signal ϕ. Then, the electrical connection state between the second capacitor electrode 119*b* and the fixed potential line 132 is switched from the conduction state to the non-conduction state.

Even if at the time T2 at which the sampling switch 202 is switched from the selection state to the non-selection state, the potential of the data line 114 is lowered by the voltage ΔV1 due to parasitic capacitance C3 between the sampling switch 202 and the data line 114, the potential of the node N2 is raised by the voltage ΔV33 at the time T3, and thus the voltage ΔV1 can be compensated by the voltage ΔV3, which is an increase in the potential of the node N1. That is, the TFT 31 is switched from the non-selection state to the selection state after the time T1, and thus the change in the potential of the pixel electrode 9a when the sampling switch 202 is switched from the conduction state to the non-conduction state is compensated.

According to this embodiment, the change in the electrode potential due to the switching operation of the sampling switch 202, as well as the TFT 30, can be compensated, and thus the display performance of the liquid crystal panel 100 can be further increased.

Modification

Figure 11:
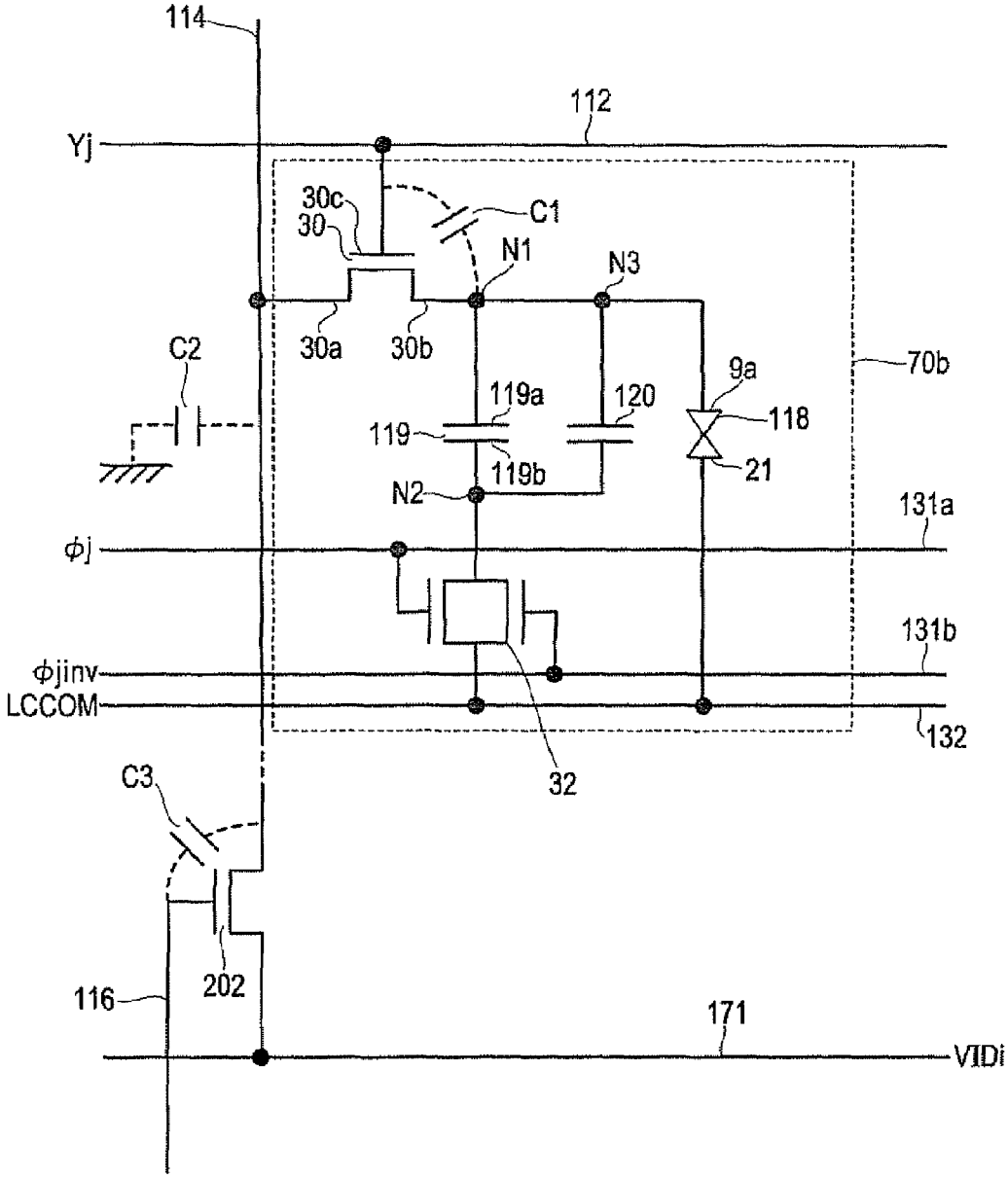
FIG. 11 is a circuit diagram showing a modification of a pixel circuit in a liquid crystal panel as an embodiment of an electro-optical device according to the invention.
Figure 12:
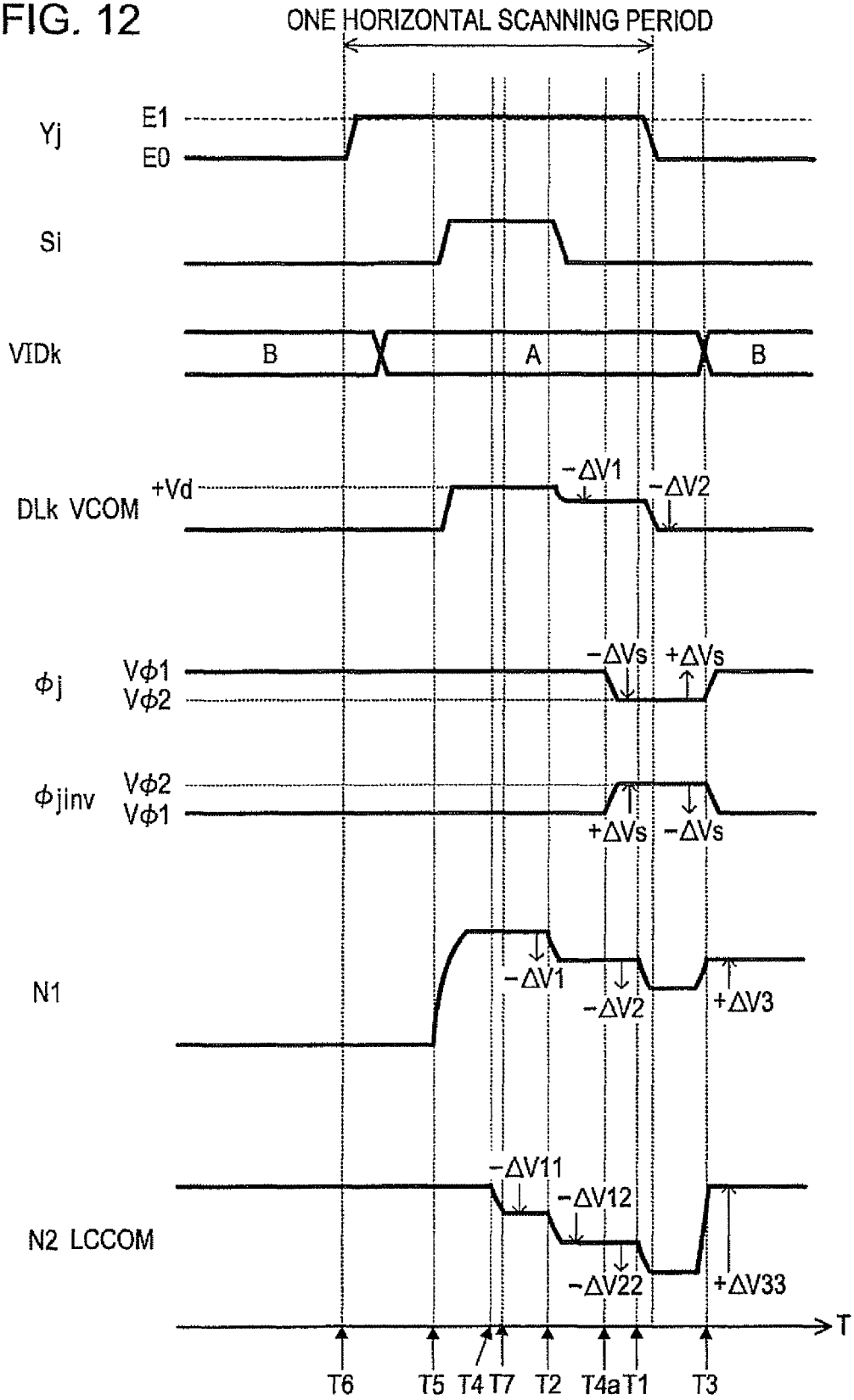
FIG. 12 is a timing chart of various signals to be supplied to a pixel circuit according to a modification with respect to a pixel circuit in a liquid crystal panel as an embodiment of an electro-optical device according to the invention.

Next, a modification of the liquid crystal panel according to this embodiment will be described with reference to FIGS. 11 and 12. FIG. 11 is a circuit diagram showing the configuration of a pixel circuit provided in a liquid crystal panel of this modification. FIG. 12 is a timing chart of various signals to be supplied to the pixel circuit shown in FIG. 11.

As shown in FIG. 11, a pixel circuit 70b provided in a liquid crystal panel of this modification has a different electrical configuration from the pixel circuit 70 in that two correction signal lines 131a and 131b for supplying two series of corrections signals ϕj and ϕjinv to the pixel circuit 70b, respectively, and a CMOS circuit 32 are provided. The CMOS circuit 32 is electrically connected to the correction signal lines 131a and 131b, the fixed potential line 132, and the second capacitor electrode 119b.

As shown in FIG. 12, in the CMOS circuit 32, the potentials of an auxiliary correction signal ϕj as an example of 'an auxiliary correction signal' and an inverted auxiliary correction signal ϕjinv serving as an example of an 'inverted auxiliary correction signal' are changed by the correction signal supply circuit 600 at a time T4a. Specifically, at the time T4a, the auxiliary correction signal ϕj is decreased from the potential Vϕ1 to the potential Vϕ2 by the voltage ΔVs. To the contrary, at the time T4a, the auxiliary corrections signal ϕjinv is increased from the potential Vϕ1 to the potential Vϕ2 by the voltage ΔVs. With this change in the potential, the CMOS circuit 32 switches the electrical connection state between the second capacitor electrode 119b and the fixed potential line 132 from the conduction state and the non-conduction state. Thereafter, at the time T3, the auxiliary correction signals ϕj and ϕjinv return to the potentials Vϕ1 and Vϕ2, respectively. Therefore, similarly to the above-described liquid crystal panel, the lowering of the potential of the pixel electrode 9a due to the operation of the TFT 30 can be compensated. In particular, in this modification, at the time T2, when the sampling switch 202 is switched from the selection state to the non-selection state, coupling capacitance is not produced between the sample switch 202 and the data line 114. Therefore, the time T4a at which the CMOS circuit 32 is switched can be set to be later than the time T2, and control about a switching process of the CMOS circuit 32 by the auxiliary correction signals ϕj and ϕjinv can be simplified.

In the liquid crystal panel of this modification, when it is assumed that no capacitive element 120 is not provided, the relationship between the voltages ΔV1, ΔV2, ΔV3, ΔV11, ΔV12, ΔV22, and ΔV33, which are the changes in potential of the nodes N1 and N2 shown in FIG. 12, parasitic capacitance C1, C2, C3, C4, C5, and C6, which are produced in the TFT 30, the data line 114, the sampling switch 202, the storage capacitor 119, the TFT 31, and the liquid crystal element 118, and the potential Vsi of the sampling signal Si, the potential VDL of the data line 114, the potential VT1 of the scanning signal, and the potential Vϕj of the correction signal ϕj are represented by Equations 8 to 13.

$$\Delta V1 = Vsi \times C3/(C3+C2) \quad \text{Equation 8}$$

$$\Delta V2 = VDL + VT1 \times C1/(C1+C4+C6) \quad \text{Equation 9}$$

$$\Delta V3 \cong \Delta V2 \quad \text{Equation 10}$$

$$\Delta V11 = V\phi j \times C5/(C5+C4) \quad \text{Equation 11}$$

$$\Delta V22 \cong \Delta V2 \quad \text{Equation 12}$$

$$\Delta V33 \cong \Delta V11 + \Delta V22 \quad \text{Equation 13}$$

Second Embodiment

Electrical Configuration of Electro-Optical Device

Figure 13:
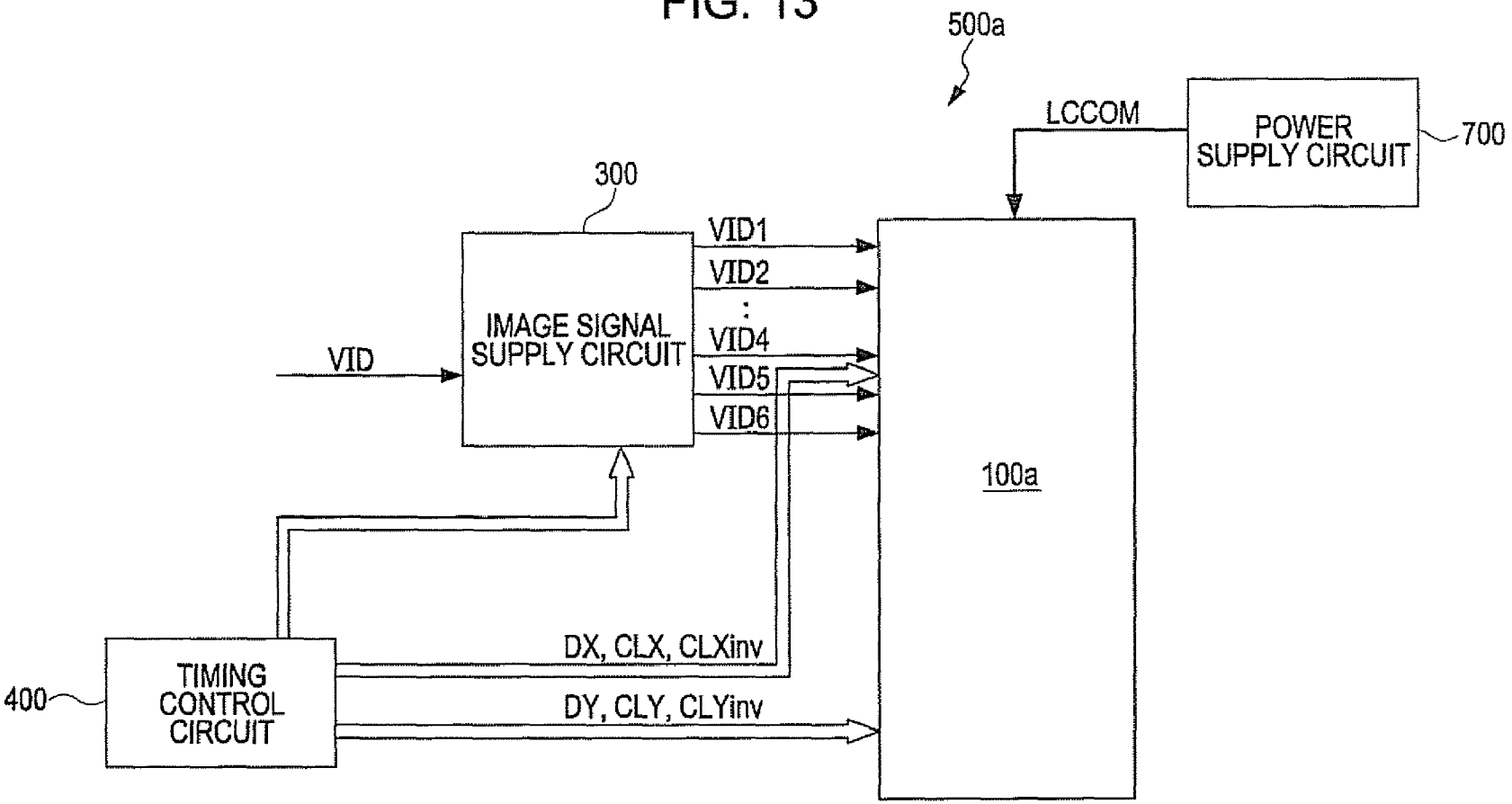
FIG. 13 is a block diagram showing the overall configuration of a liquid crystal panel as another embodiment of an electro-optical device according to the invention.
Figure 14:
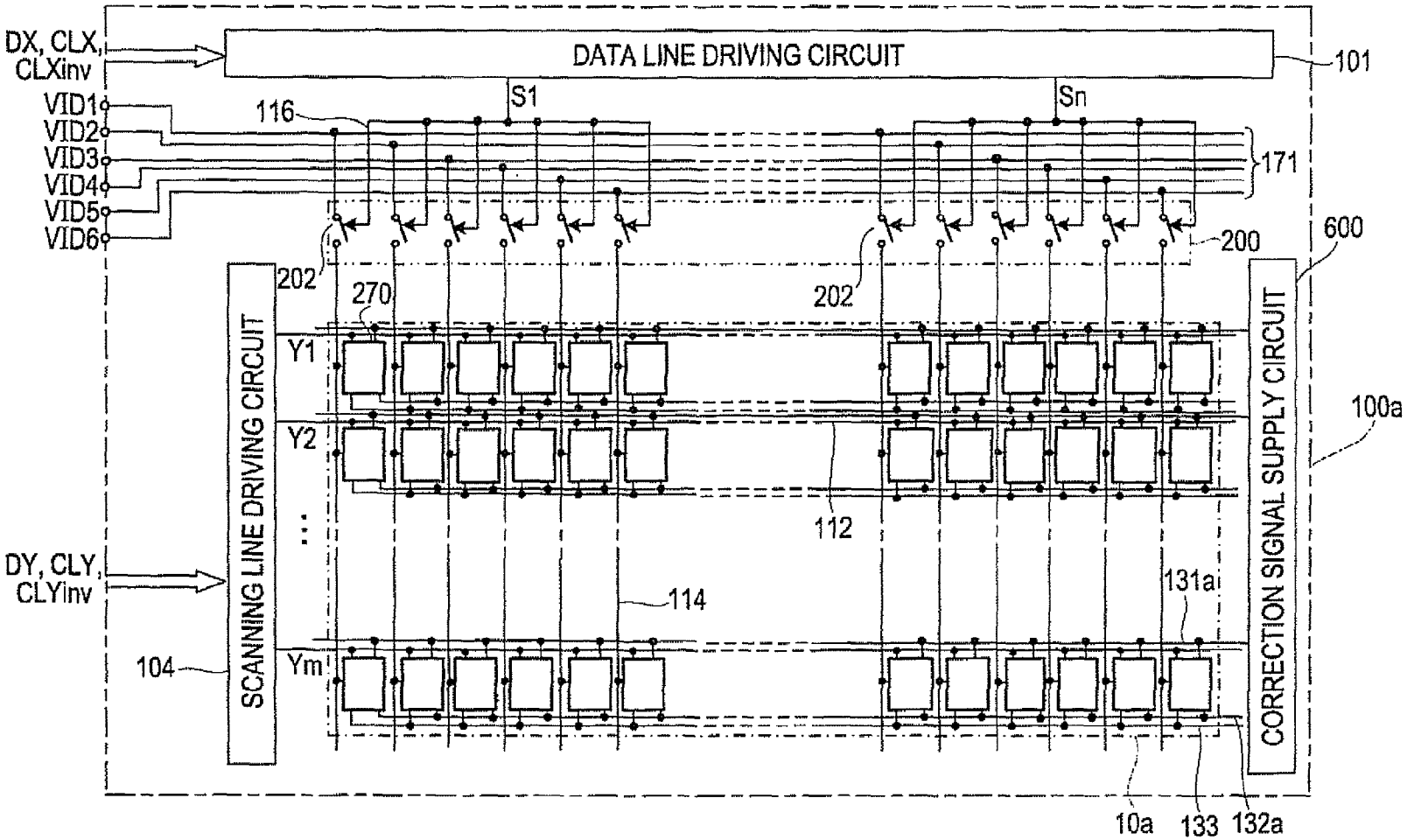
FIG. 14 is a block diagram showing the electrical configuration of a liquid crystal panel as another embodiment of an electro-optical device according to the invention.

Next, an embodiment of an electro-optical device according to the invention and an electronic apparatus according to the invention will be described with reference to FIGS. 13 to 27. FIG. 13 is a block diagram showing the overall configuration of a liquid crystal device including a liquid crystal panel 100a. FIG. 14 is a block diagram showing the electrical configuration of the liquid crystal panel 100a.

An electro-optical device of this embodiment is a liquid crystal device which is the same as the electro-optical device of the first embodiment. Therefore, as for the electro-optical device of this embodiment, the same parts as those in the above-described liquid crystal device are represented by the same reference numerals, and detailed descriptions thereof will be omitted. As for the parts represented by the same reference numerals as the above-described liquid crystal device, when a part performs a different operation from a corresponding part in the above-described liquid crystal device, the operation will be described separately. The electro-optical device of this embodiment and the above-described liquid crystal device have the same overall configuration. Thus, in the following description, detailed illustration and description of the electro-optical device of this embodiment will be omitted.

As shown in FIG. 13, a liquid crystal device 500a includes a liquid crystal panel 100a, and an image signal supply circuit 300, a timing control circuit 400, and a power supply circuit 700, which are provided as external circuits.

As shown in FIG. 14, the liquid crystal panel 100a includes correction signal lines 131a, and power lines 132a and 133. The correction signal lines 131a electrically connect the correction signal supply circuit 600 and the pixel circuits 270. As described below, a correction signal output from the correction signal supply circuit 600 is supplied to the pixel circuits 270 through the correction signal lines 131a. The power lines 132a supply a common potential LCCOM, which is supplied from the external circuit, to the pixel circuits 270. The power lines 133 supply a fixed potential VCOM described below to the pixel circuits 270.

Configuration and Operation of Pixel Circuit

Figure 15:
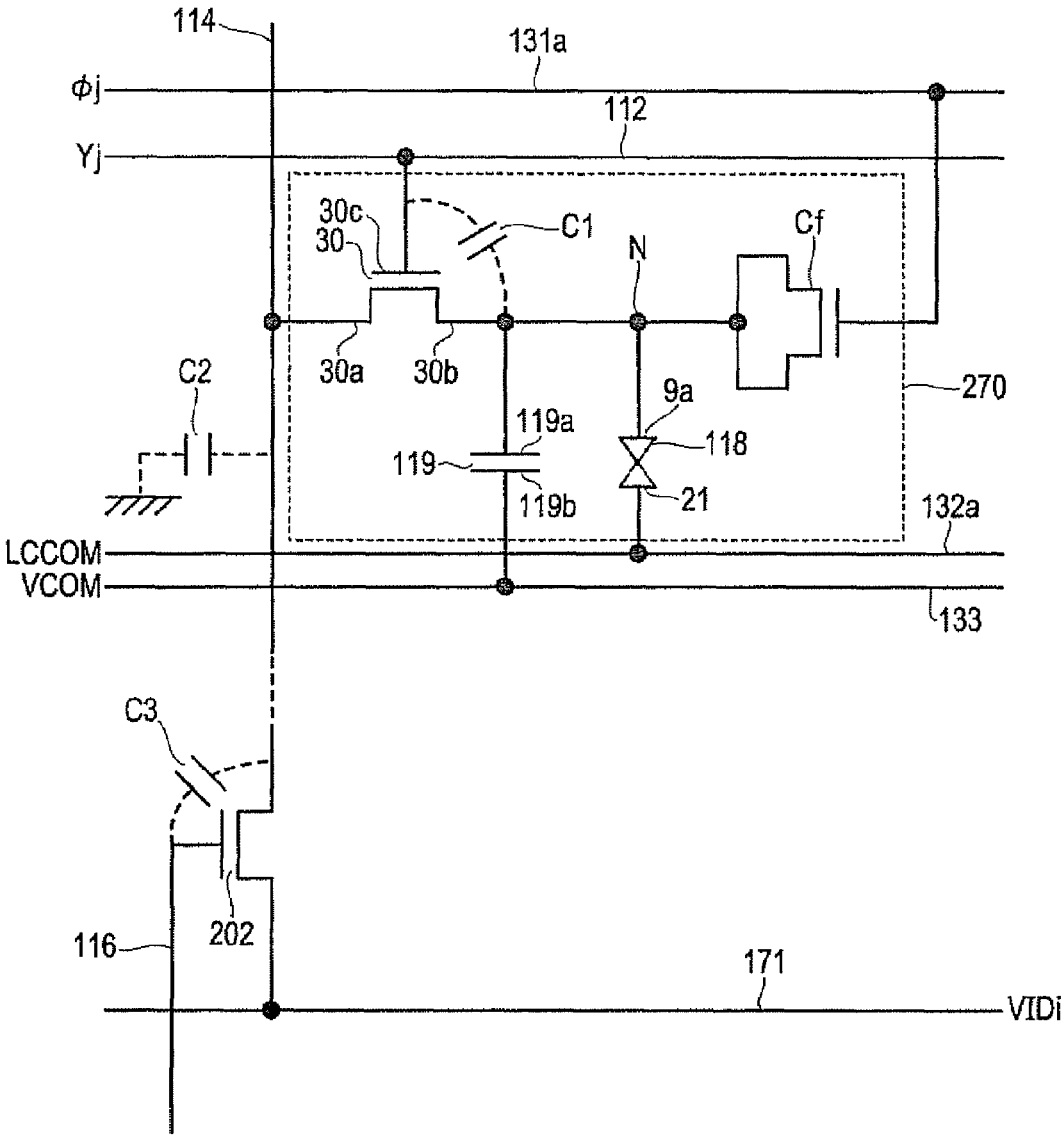
FIG. 15 is a circuit diagram showing the configuration of a pixel circuit in a liquid crystal panel as another embodiment of an electro-optical device according to the invention, together with a sampling switch.
Figure 16A:
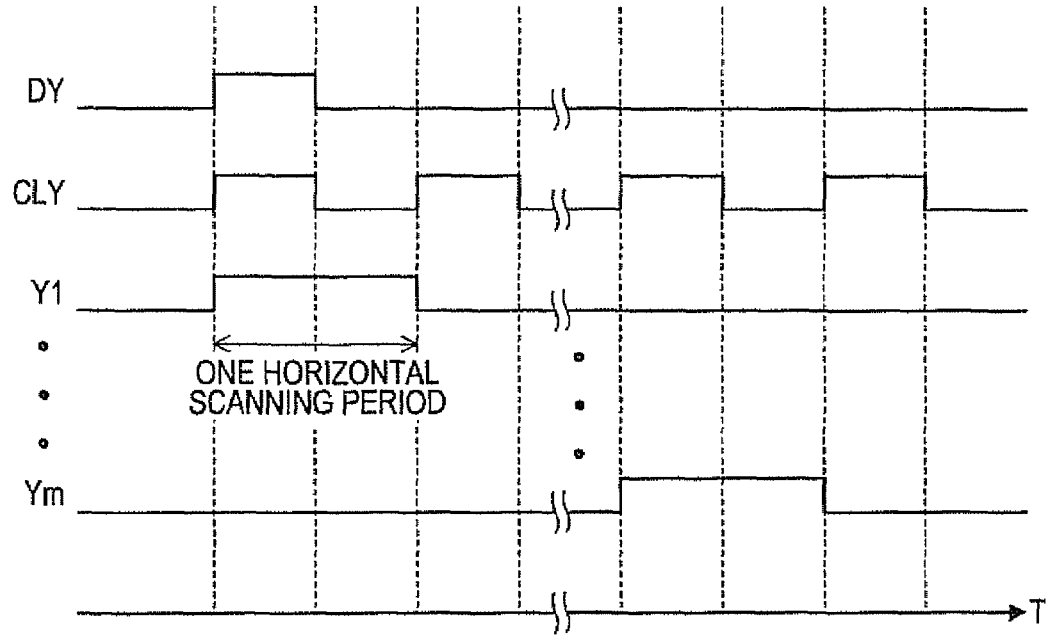
FIGS. 16A and 16B are timing charts (first one) of various signals to be supplied to a liquid crystal panel as another embodiment of an electro-optical device according to the invention.
Figure 16B:
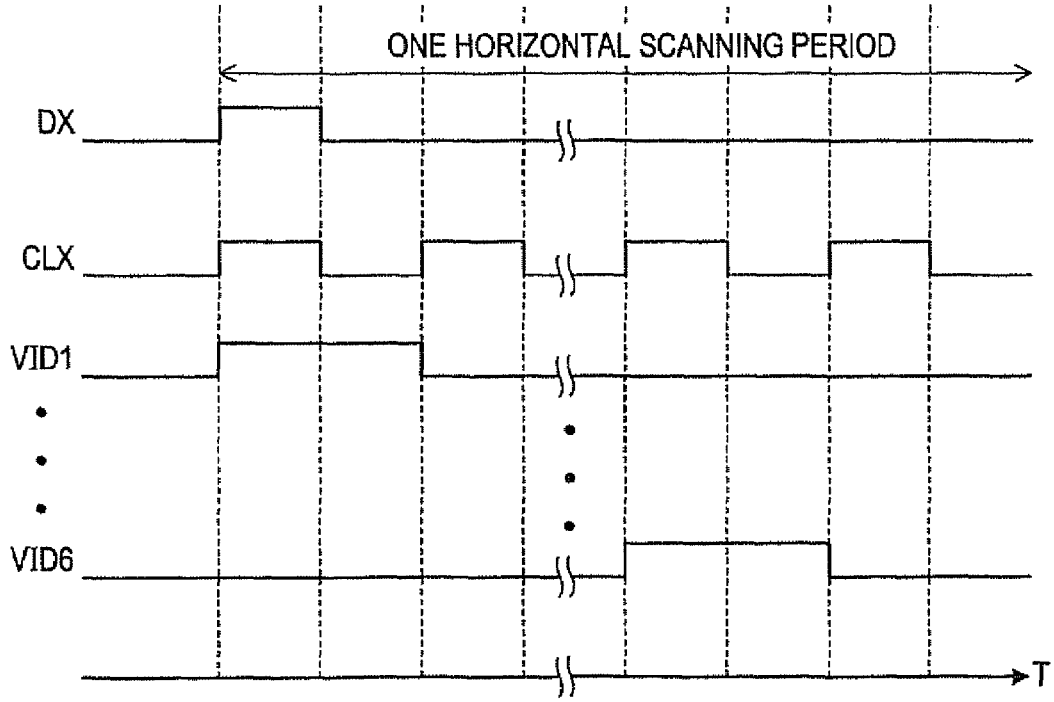
Figure 17:
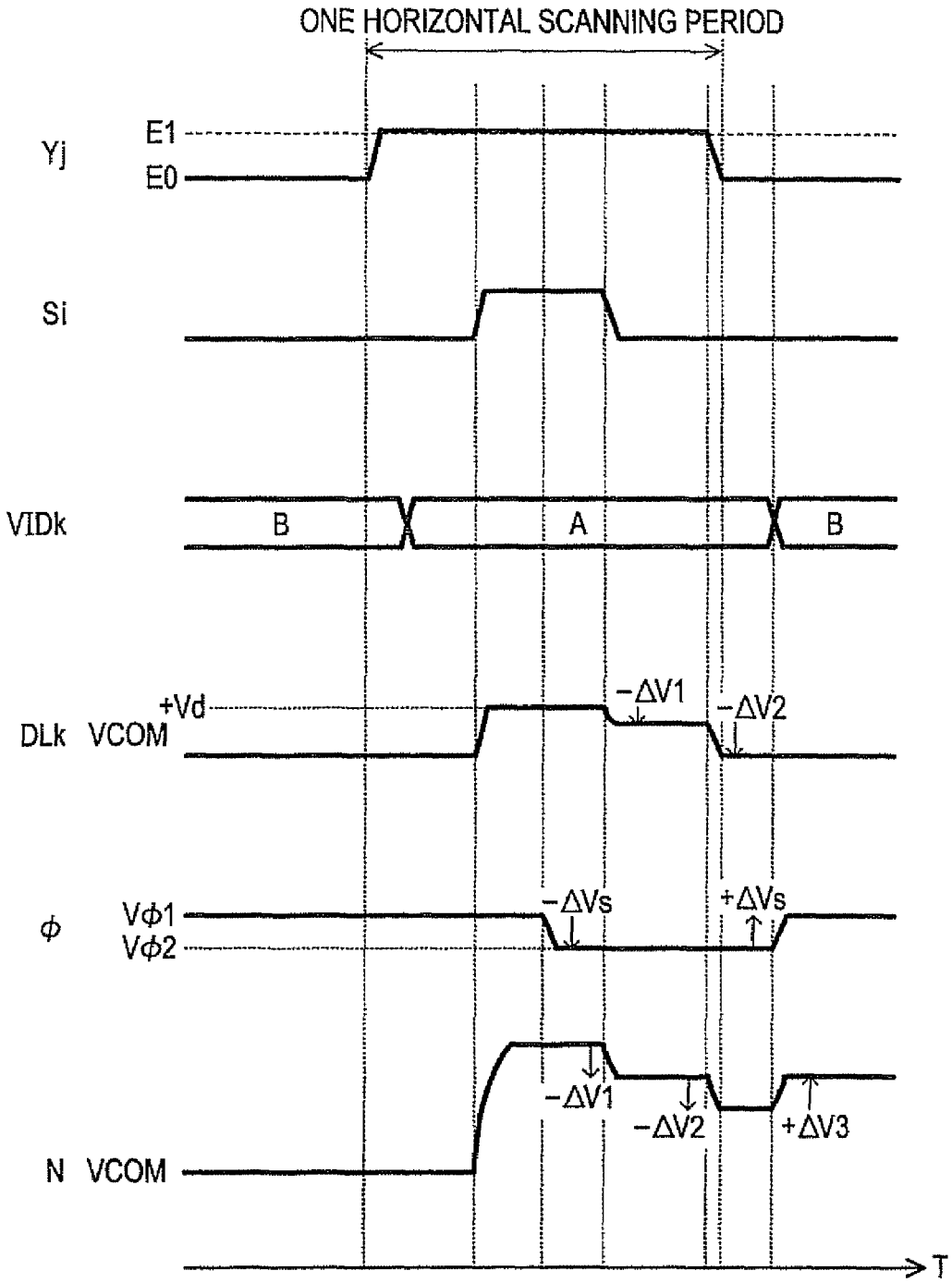
FIG. 17 is a timing chart (second one) of various signals to be supplied to a liquid crystal panel as another embodiment of an electro-optical device according to the invention.
Figure 18:
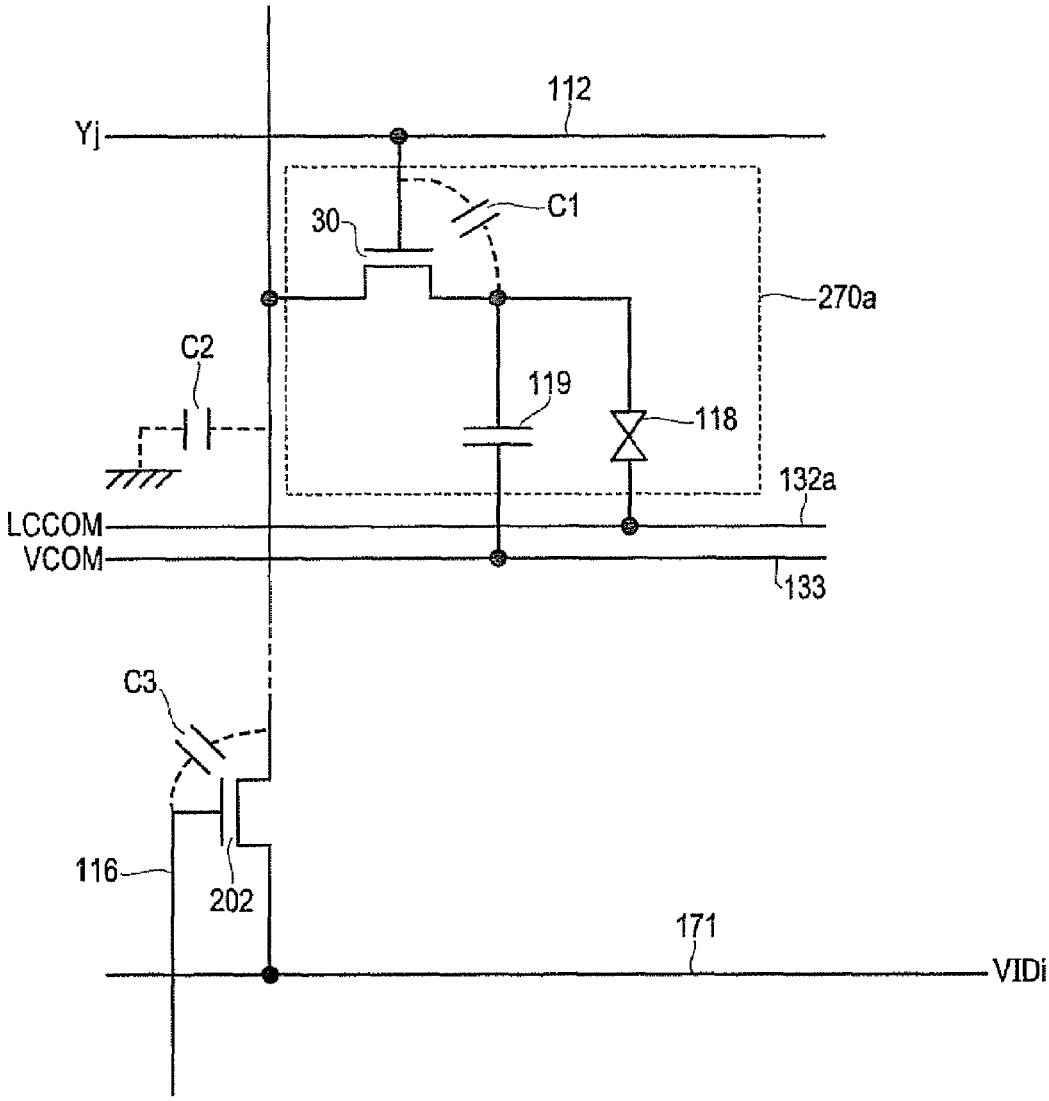
FIG. 18 is a circuit diagram of a pixel circuit according to a comparative example with respect to a pixel circuit in a liquid crystal panel as another embodiment of an electro-optical device according to the invention.
Figure 19:
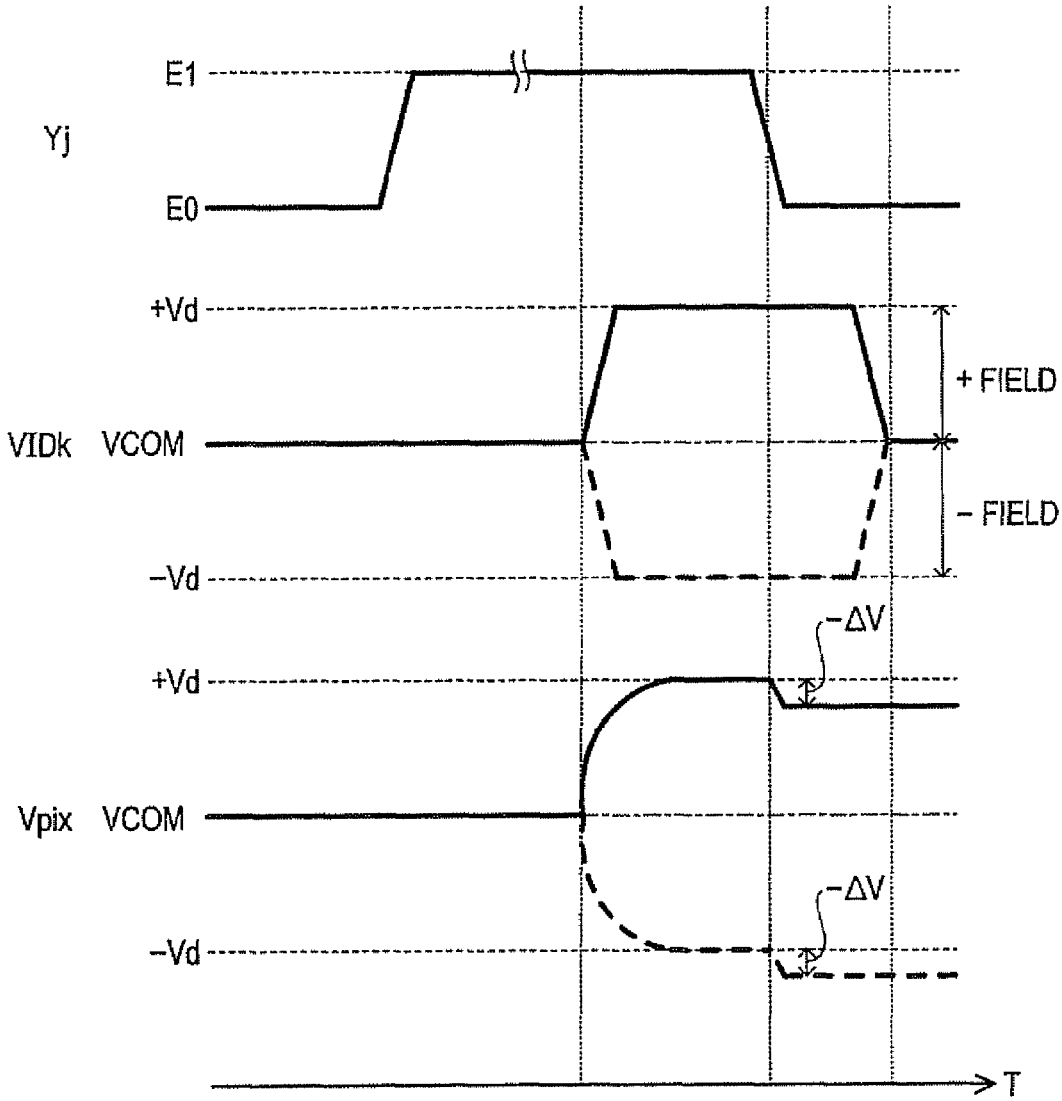
FIG. 19 is a timing chart of various signals to be supplied to a pixel circuit according to a comparative example with respect to a pixel circuit liquid crystal panel as another embodiment of an electro-optical device according to the invention.
Figure 20:
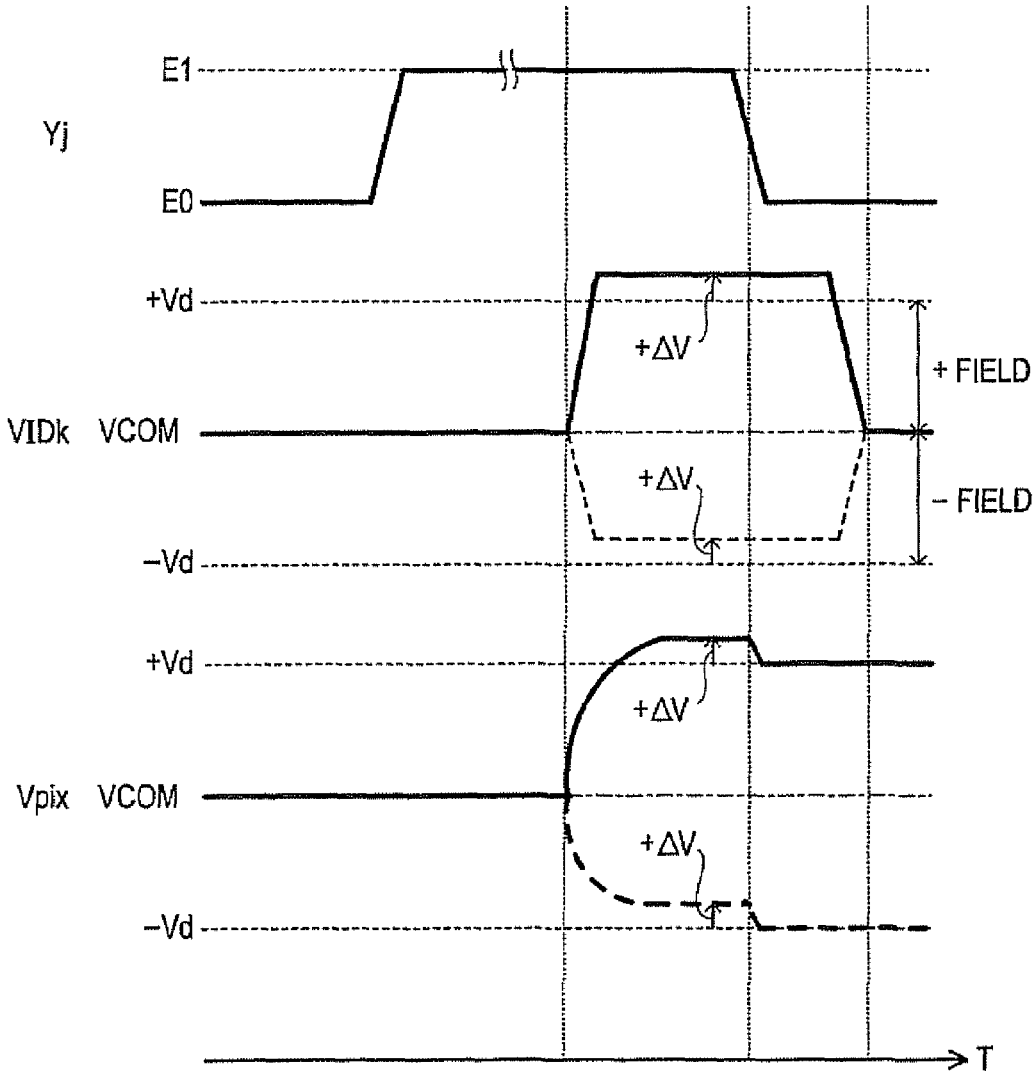
FIG. 20 is another timing chart of various signals to be supplied to a pixel circuit according to a comparative example with respect to a pixel circuit in a liquid crystal panel as another embodiment of an electro-optical device according to the invention.

Next, the electrical configuration and operation of the pixel circuit 270 will be described with reference to FIGS. 15 to 20. FIG. 15 is a circuit diagram showing the configuration of the pixel circuit 270 according to this embodiment, together with a sampling switch 202. FIGS. 16A and 16B and FIG. 17 are timing charts of various signals to be supplied to the liquid crystal panel according to this embodiment. FIG. 18 is a circuit diagram of a pixel circuit according to a comparative example with respect to the pixel circuit in the liquid crystal panel according to this embodiment. FIG. 19 is a timing chart of various signals to be supplied to the pixel circuit shown in FIG. 18. FIG. 20 is another timing chart of various signals to be supplied to a pixel circuit according to a comparative example.

As shown in FIG. 15, the pixel circuit 270 includes a liquid crystal element 118 serving as an example of a 'display element' of the invention, a pixel electrode 9*a*, a TFT 30 serving as an example of a 'driving transistor element' of the invention, a node N, a storage capacitor 119, and a capacitive element Cf serving as an example of a 'capacitance unit' of the invention.

When the liquid crystal panel 100*a* operates, the liquid crystal element 118 is configured such that the alignment state of liquid crystal is controlled by a voltage between the pixel electrode 9*a* and a counter electrode 21 opposed to the pixel electrode 9*a*. Then, light emitted from a light source is transmitted in accordance with the alignment state.

The TFT 30 has a source electrode 30*a* serving as an example of an 'input terminal' of the invention, a drain electrode 30*b* serving as an example of an 'output terminal' of the invention, and a gate electrode 30*c*. When the liquid crystal panel 100*a* operates, the TFT 30 controls the operation of the liquid crystal element 118 through the pixel electrode 9*a*. Specifically, as shown in FIGS. 14 and 15, the source electrode 30*a* of the TFT 30 is electrically connected to the data line 114 to which the image signal VIDk (where k=1, 2, 3, . . . , and 6) is supplied. The gate electrode 30*c* of the TFT 30 is electrically connected to the scanning line 112 to which the scanning signal Yj (where j=1, 2, 3, . . . , and m) is supplied, and the drain electrode 30*b* of the TFT 30 is connected to the pixel electrode 9*a* of the liquid crystal element 118.

The source electrode 30*a* and the drain electrode 30*b* are electrically connected to a source region and a drain region of an active layer constituting a part of the TFT 30, respectively. In this embodiment, as an active matrix driving method that drives the liquid crystal panel 100*a*, an inversion driving method in which the polarity of the image signal is inverted is used. Therefore, the potentials of the source region and the drain region, which are electrically connected to the source electrode 30*a* and the drain electrode 30*b*, respectively, are switched with each other in accordance with the polarity of the image signal. Specifically, when the TFT 30 is an N-channel type TFT, and a positive-polarity image signal is supplied to the source electrode 30*a*, the source electrode 30*a* is at a potential higher than the drain electrode 30*b*. When a negative-polarity image signal is supplied to the source electrode 30*a*, the source electrode 30*a* is at a potential lower than the drain electrode 30*b*, and functions as a drain electrode. In the pixel circuit 270, the liquid crystal element 118 includes the pixel electrode 9*a* and the counter electrode 21 with liquid crystal interposed therebetween.

In the pixel circuit 270 corresponding to the scanning line 112 to which the scanning signal Yj is supplied, that is, the pixel circuit 270 corresponding to the selected scanning line 112, if the scanning signal Yj is supplied to the TFT 30, the TFT 30 is turned on (that is, switched from the non-selection state to the selection state), and the pixel circuit 70 is put in a selection state. While the TFT 30 is switched on during a predetermined period, the image signal VIDk is input to the pixel electrode 9*a* of the liquid crystal element 118 from the data line 114 at a predetermined timing.

Accordingly, a voltage defined by the potentials of the pixel electrode 9*a* and the counter electrode 21 is applied to the liquid crystal element 118. The alignment or order of molecules of liquid crystal is changed in accordance with the application voltage, such that gray-scale display can be performed by light modulation. In a normally white mode, transmittance of incident light decreases in accordance with the application voltage to each pixel. In a normally black mode, transmittance of incident light increases in accordance with the application voltage to each pixel. As a whole, light having contrast according to the image signals VID1 to VID6 is emitted from the liquid crystal panel 100*a*.

As shown in FIG. 15, the storage capacitor 119 includes a first capacitor electrode 119*a*, a second capacitor electrode 119*b*, and a dielectric layer (not shown) interposed between the capacitor electrodes. The storage capacitor 119 has a laminate structure in which a dielectric layer, which is a part of an interlayer insulating film formed on the TFT array substrate 10, is interposed between the first capacitor electrode 119*a* and the second capacitor electrode 119*b* serving as a pair of capacitor electrodes.

The second capacitor electrode 119*b* is electrically connected to the power line 133 and is supplied with the fixed potential VCOM through the power line 133 when the liquid crystal panel 100*a* operates. The first capacitor electrode 119*a* is electrically connected to the drain electrode 30*b* of the TFT 30. That is, the storage capacitor 119 is provided in parallel to the liquid crystal element 118, and maintains the potential of the pixel electrode 9*a* set according to the image signal VIDk. Specifically, when the liquid crystal device operates, the second capacitor electrode 119*b* is supplied with the same potential as that of the counter electrode opposed to the pixel electrode 9*a* or a fixed potential VCOM different from the common potential to be supplied to the counter electrode, and operates to maintain the potential of the pixel electrode 9*a*.

In order to prevent leakage of the image signal maintained in the pixel electrode 9*a*, the potential of the pixel electrode 9*a* is maintained by the storage capacitor 119 for a period of time, for example, three digits longer than the time of application of a source voltage. Therefore, a maintaining property is improved, and thus a high contrast ratio is achieved.

However, due to capacitance C1 between the gate and drain of the TFT 30 when the TFT 30 operates, capacitance C2 between the data line 114 and the ground, or capacitance C3 between the gate and drain of the sampling switch 202 when the sampling switch 202 is switched from the selection state to the non-selection state, the potential of the pixel electrode 9*a*, that is, the potential of the node N in a connection path electrically connecting the pixel electrode 9*a* and the drain electrode 30*b* is lowered by a pushdown phenomenon. For this reason, display performance of the liquid crystal panel 100*a* is deteriorated. Accordingly, as described below, the pixel circuit 70 compensates for a change in the potential of the node N, that is, the potential of the pixel electrode 9*a* by using a capacitive element Cf, thereby improving the display performance of the liquid crystal panel 100*a*.

The electro-optical device according to the invention is not limited to a liquid crystal device that displays an image by using a modulation element, such as a liquid crystal element, which emits display light by light modulation. For example, the electro-optical device may be a display device that includes a pixel circuit having a display element, for example, a self-luminous element, such as an EL element. In such a display device, an electrode for supplying a driving current to a light-emitting layer is an example of the driving electrode. In this case, the lowering of the electrode potential due to the pushdown phenomenon is compensated in the same manner as the liquid crystal panel 100*a*.

Next, the operation of the pixel circuit 270 will be described with reference to FIGS. 15 to 17.

As shown in FIGS. 15 and 16A, the scanning signals Y1, . . . , and Ym are sequentially supplied to the scanning lines 112 in accordance with the Y clock signal CLY and the Y start pulse DY supplied to the liquid crystal panel 100*a*. As shown in FIGS. 15 and 16B, the image signals VID1, . . . , and VID6 are supplied to the sampling circuit 200 through the image signal lines 117 in accordance with the X start pulse DX and the X clock signal CLX supplied to the data line driving circuit 101 during one horizontal scanning period. A plurality of sampling switches 202 constituting the sampling circuit 200 are switched from the off state (that is, the non-selection state) to the on state (that is, the selection state) in accordance with the sampling signals Si, which are output from the data line driving circuit 101 in accordance with the X clock signal CLX, and supply the image signals VID1, . . . , and VID6 to the data lines 114 corresponding to the image signals.

The generation process of the pushdown phenomenon in which the potential of the pixel electrode 9*a*, that is, the potential of the node N is lowered will be described with reference to FIGS. 18 to 20, together with the operation of a pixel circuit in a liquid crystal panel according to a comparative example with respect to the liquid crystal panel according to this embodiment. In the following description, the same parts as those in the liquid crystal panel according to this embodiment are represented by the same reference numerals, and descriptions thereof will be omitted.

As shown in FIG. 18, the electrical configuration of a pixel circuit 270*a* in a liquid crystal panel according to a comparative example is different from that of the pixel circuit 270 in that the capacitive element Cf and the correction signal line 131*a* are not provided.

As shown in FIG. 19, after the scanning signal Yj is supplied to the scanning line 112, that is, after the potential of the scanning line 112 rises from a potential E0 to a potential E1 in accordance with the supply of the scanning signal Yj, the image signal VIDk is supplied to the data line 114. The image signal VIDk is supplied while the polarity is inverted to positive or negative with respect to the fixed potential VCOM for every predetermined period, for example, one field period. In FIG. 19, the positive-polarity image signal VIDk is at a potential higher by a potential Vd than the fixed potential VCOM, and the negative-polarity image signal VIDk is at a potential lower by a potential Vd than the fixed potential VCOM.

If the image signal VIDk has a positive polarity, when the sampling switch 202 is switched from the non-conduction state to the selection state, the potential of the node N, that is, the electrode potential Vpix of the pixel electrode 9*a* rises to a potential +Vd higher than the fixed potential VCOM.

However, when the TFT 30 is switched from the non-selection state to the selection state, the electrode potential Vpix of the pixel electrode 9*a* is lowered by a potential ΔV due to capacitance C1 between the gate and drain of the TFT 30. The lowering of the electrode potential Vpix occurs whichever of the positive-polarity image signal VIDk and the negative-polarity image signal VIDk is supplied.

Here, as shown in FIG. 20, in order to reduce the change ΔV in the electrode potential Vpix, a method that compensates for a variation in the electrode potential Vpix by setting the potential of the image signal VIDk to be higher by ΔV than a target potential +Vd or −Vd in advance may be considered.

In this case, however, it is necessary to control the potential of the image signal, which is supplied to the liquid crystal panel outside of the liquid crystal panel, by using an external circuit, such as the image signal supply circuit 300, and to change design of the external circuit. In addition, it is necessary to increase a gate voltage of the TFT 30 for supplying the image signal VIDk at a high potential to the pixel electrode 9*a*. Accordingly, voltage resistance of the scanning lines 112 needs to be increased, and as for design of the liquid crystal panel, portions to be changed are increased.

Therefore, as described in detail with reference to FIGS. 15 and 17, the change in the potential of the node N, that is, the electrode potential Vpix of the pixel electrode 9*a* is compensated by using the capacitive element Cf in the liquid crystal panel 100*a* of this embodiment.

Referring to FIGS. 15 and 17, if the sampling signal Si is supplied to the sampling switch 202 during one horizontal scanning period in which the scanning signal Yj is supplied, the image signal VIDk is sampled to the data line 114 corresponding to the image signal VIDk, and the potential DLk of the data line 114 is raised. In FIG. 17, a period in which the positive-polarity image signal VIDk is supplied is represented by A, and a period in which the negative-polarity image signal VIDk is supplied is represented by B. In this embodiment, for simplification of explanation, the operation of the pixel circuit 270 will be described in connection with the period in which the positive-polarity image signal VIDk is supplied. Therefore, in FIG. 17, the image signal VIDk sampled according to the sampling signal Si has a positive polarity, and the potential DLk of the data line 114 to which the image signal VIDk is supplied is increased at a potential Vd higher than the fixed potential VCOM.

The capacitive element Cf is electrically connected to the correction signal line 131*a* and the node N between the correction signal line 131*a* and the node N to which the correction signal ϕj is supplied from the correction signal supply circuit 600 (see FIG. 4). On the basis of the correction signal ϕj, the capacitive element Cf compensates for a first change −ΔV2 in the node N when the TFT 30 is switched from the selection state to the non-selection state.

Specifically, before the scanning signal Yj falls, that is, the scanning signal Yj falls from the potential E1 to the potential E0, the correction signal supply circuit 600 falls the correction signal ϕ from a first potential Vϕ1 to a second potential Vϕ2 by a differential voltage ΔVs. Thereafter, after the potential of the scanning signal Yj falls, the correction signal supply circuit 600 rises the correction signal ϕ from the second potential Vϕ2 to the first potential Vϕ1. As such, by changing the potential of the correction signal ϕ, the capacitive element Cf compensates for the change in the electrode potential Vpix of the pixel electrode 9*a* according to the change in the potential of the correction signal ϕ, and maintains the electrode potential Vpix in accordance with the potential of the image signal VIDk.

The differential voltage ΔVs is set so as to compensate for at least the first change −ΔV2, which is a change in potential when the TFT 30 is switched from the selection state to the non-selection state, from a variation in the potential of the node N, that is, the electrode potential Vpix, with respect to the potential of the image signal VIDk when the liquid crystal panel 100 operates. Specifically, a change +ΔV3 in potential to be compensated by the capacitive element Cf can be calculated on the basis of capacitance Cf of the capacitive element Cf, capacitance CcapA of the storage capacitor 119, capacitance C1 between the gate and drain of the TFT 30, and the differential voltage ΔVs by Equation 14.

$$\Delta V3=\Delta Vs\cdot Cf/(C1+CcapA+Cf) \qquad \text{Equation 14}$$

The capacitive element Cf refers to gate capacitance in which the gate insulating film of the TFT 30 or an insulating film formed in the same layer as the gate insulating film is used as a dielectric film, SD junction capacitance between the source region and the drain region of the TFT 30, capacitance in which wiring lines on the TFT array substrate 10 are used as a pair of electrodes, and an insulating film extending between the electrodes is used as a dielectric film, parasitic capacitance between the wiring lines, or various capacitance circuits that generates capacitance by using other transistor elements. The capacitive element Cf operates to compensate for the first change −ΔV2 in the potential of the node N, that is, the electrode potential Vpix when the TFT 30 is switched from the selection state to the non-selection state. Specifically, what is necessary is that the capacitive element Cf can compensate for electric charges corresponding to the amount of electric charges from the node N, that is, the pixel electrode 9*a* when the TFT 30 is switched from the selection state to the non-selection state.

In the liquid crystal panel 100*a* of this embodiment, not only when the TFT 30 is switched from the selection state to the non-selection state, but when the sampling signal Si falls, that is, the sampling switch 202 is switched from the selection state to the non-selection state, the potential of the node N is lowered by a second change ΔV1 due to capacitance C3 caused by the switching operation of the sampling switch 202. The capacitive element Cf can also compensate for the second change −ΔV1 which is a change in the potential of the node N due to capacitance C3. Specifically, in compensating for the second change ΔV1, as well as the first change ΔV2, a time at which the correction signal ϕ falls from the first potential Vϕ1 to the second potential Vϕ2 is set to be earlier than a second time at which the sampling signal Si falls. With this time, the correction signal ϕ falls from the first potential Vϕ1 to the second potential Vϕ2, and a change ΔV3 is set while taking the second change ΔV1 in the potential of the node N into consideration. Therefore, both the first change ΔV2 and the second change ΔV1 can be compensated.

In this embodiment, a combination of the differential voltage ΔVs and capacitance Cf may be set such that at least the first change ΔV2 from among the first change ΔV2 and the second change ΔV1 can be compensated. When the combination of the differential voltage ΔVs and capacitance Cf can be made settable, even if design of the capacitive element Cf is limited, and capacitance Cf is limited, the differential voltage ΔVs can be appropriately set, and thus at least the first change ΔV2 from among the first change ΔV2 and the second change ΔV1 can be compensated.

When the set value of the differential voltage ΔVs is limited, that is, the set values of the first potential Vϕ1 and the second potential Vϕ2 are limited, by appropriately setting capacitance Cf, at least the first change ΔV2 can be compensated. Therefore, according to the liquid crystal panel of this embodiment, the degree of freedom in design of the capacitive element Cf, which is formed on the TFT array substrate 10, and the degree of freedom in the set value of the differential voltage ΔV can be increased.

As described above, according to the liquid crystal panel 100*a* of this embodiment, the lowering of the potential of the pixel electrode 9*a* when the TFT 30 is switched from the selection state to the non-selection state can be suppressed. In addition, the potential of the pixel electrode 9*a* can be maintained (that is, held) at a potential according to the potential of the image signal VIDk, and defective display due to the change in the electrode potential Vpix of the pixel electrode 9*a* can be reduced. In particular, when the image signal VIDk is in forms of an analog signal, the alignment state of liquid crystal in the liquid crystal element 118 is determined in advance by a V-T curve, which defines the relationship between the voltage V applied to liquid crystal and a time T for which the voltage V is maintained. Therefore, if the potential of the pixel electrode is maintained (that is, held) for a longer time, a variation in luminance of the pixel with respect to the target luminance can be effectively suppressed, and the display performance of the liquid crystal panel can be increased.

According to the liquid crystal panel 100*a* of this embodiment, immediately after the TFT 30 is switched from the selection state to the non-selection state, the correction signal ϕ can be supplied to the capacitive element Cf. Therefore, a precharge period in which the data line 114 is precharged can be ensured.

According to the liquid crystal panel 100*a* of this embodiment, the electrode potential of the pixel electrode can be compensated, without needing a corrected image signal from an external circuit provided separately from the pixel circuit 270*a*. Therefore, the circuit configuration on the TFT array substrate 10 can be simplified. In addition, for high definition of an image, even if the pixel size is set to be small, the pixels can be made fine while an increase in the size of the pixel circuit of each pixel can be suppressed so as to be as small as possible.

Modification

Figure 21:
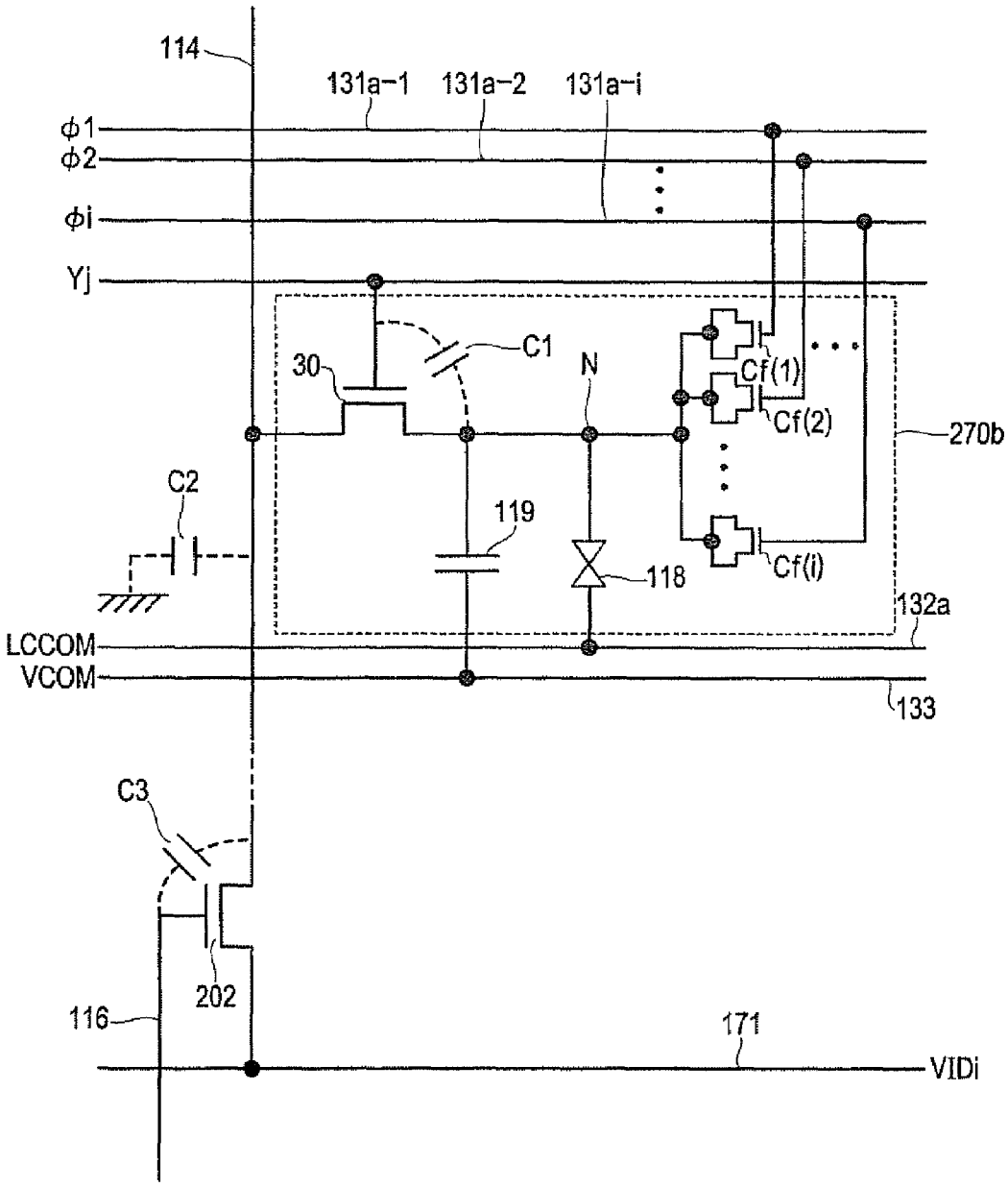
FIG. 21 is a circuit diagram showing a modification of a pixel circuit in a liquid crystal panel as another embodiment of an electro-optical device according to the invention.
Figure 22:
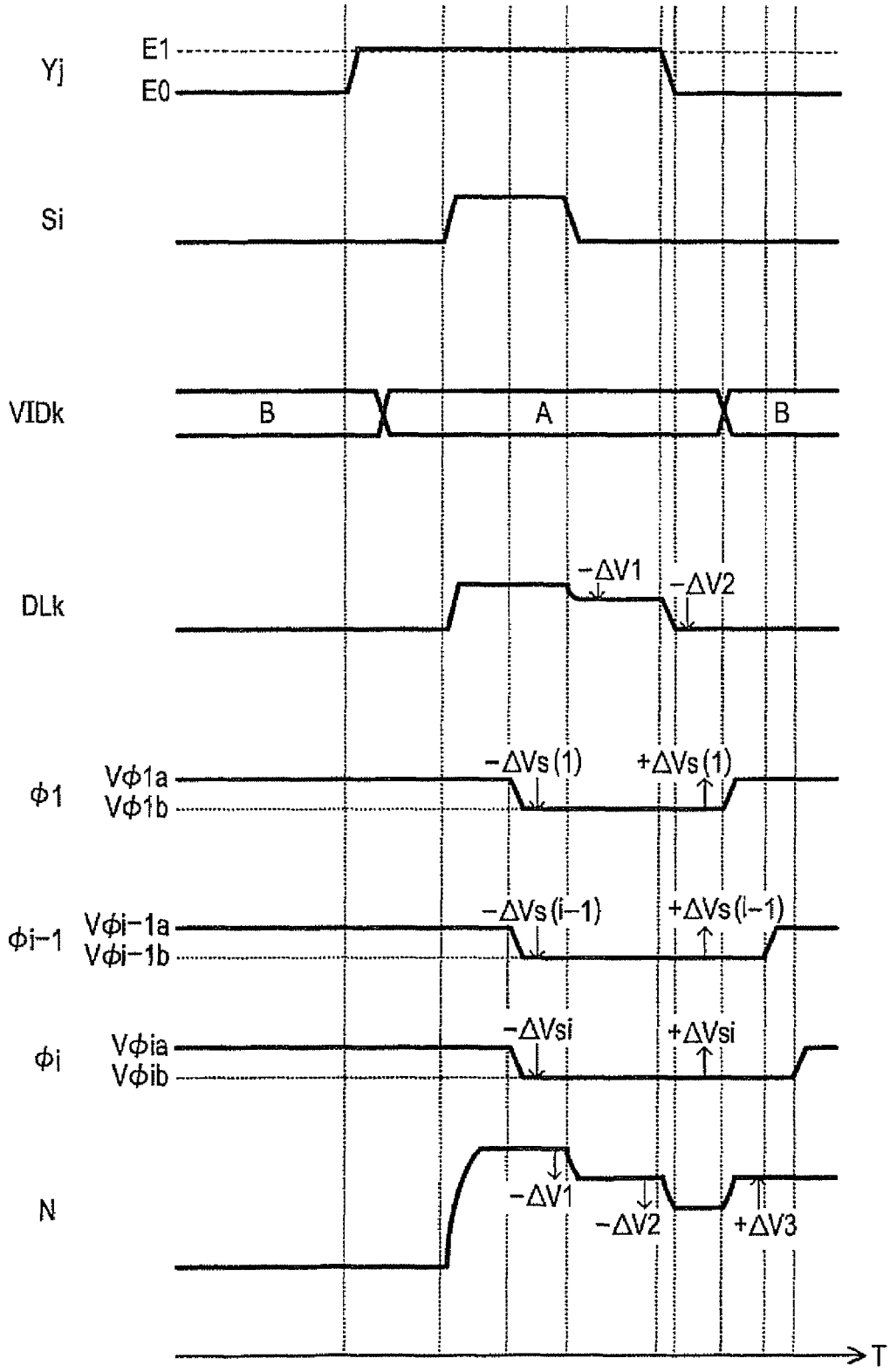
FIG. 22 is a timing chart of various signals to be supplied to a pixel circuit according to a modification with respect to a pixel circuit in a liquid crystal panel as another embodiment of an electro-optical device according to the invention.
Figure 23:
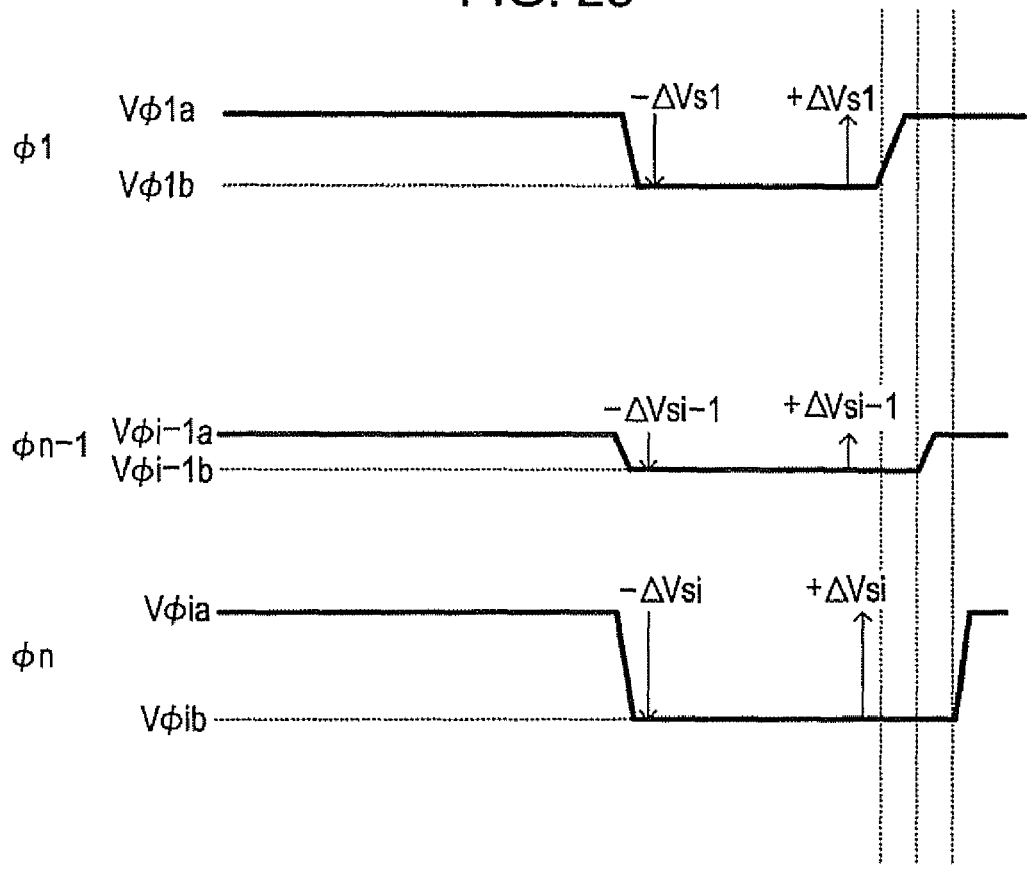
FIG. 23 is a detailed timing chart showing the waveform of a correction signal to be supplied to a pixel circuit according to a modification with respect to a pixel circuit in a liquid crystal panel as another embodiment of an electro-optical device according to the invention.
Figure 24:
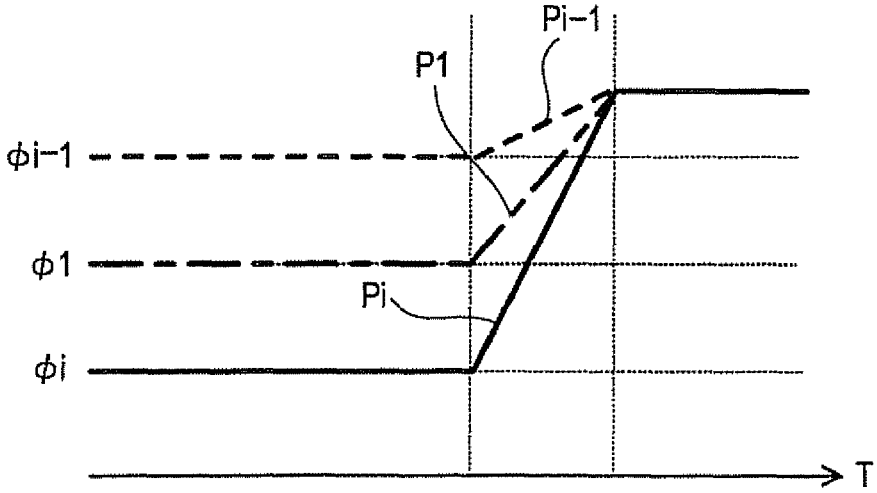
FIG. 24 is a detailed timing chart showing a part of the waveform of the correction signal shown in FIG. 23.

Next, a modification of the liquid crystal panel according to this embodiment will be described with reference to FIGS. 21 to 24. FIG. 21 is a circuit diagram showing the configuration of a pixel circuit in a liquid crystal panel according to this modification. FIG. 22 is a timing chart of various signals to be supplied to the pixel circuit shown in FIG. 21. FIG. 23 is a detailed timing chart showing the waveform of a correction signal. FIG. 24 is a detailed timing chart showing a part of the waveform of the correction signal shown in FIG. 23.

As shown in FIG. 21, a pixel circuit 270*b* in the liquid crystal panel of this modification is different from the above-described pixel circuit 270 in that a plurality of auxiliary capacitive elements Cf(1), . . . , and Cf(i) are provided.

Each of the auxiliary capacitive elements Cf(1), . . . , and Cf(i) is an example of an 'auxiliary capacitance unit' in the invention. The auxiliary capacitive elements Cf(1), . . . , and Cf(i) are electrically connected between a plurality of auxiliary correction signal lines 131*a*-1, . . . , and 131*a*-*i* corresponding to the auxiliary capacitive elements and the node N, respectively. When the liquid crystal panel operates, a plurality of auxiliary correction signals ϕ1, . . . , and ϕi are supplied from an auxiliary correction signal supply circuit to the plurality of auxiliary capacitive elements Cf(1), . . . , and Cf(i) through the plurality of auxiliary correction signal lines 131*a*-1, . . . , and 131*a*-*i*, respectively.

As shown in FIGS. 21 and 22, similarly to when the liquid crystal panel 100*a* operates, the pushdown phenomenon occurs at a time at which the sampling signal Si falls and a time at which the scanning signal Yj falls, and accordingly the potential DLk of the data line 114 is lowered by the voltages ΔV1 and ΔV2, respectively. In the liquid crystal panel of this modification, instead of using a single capacitive element so as to compensate for the lowering of the potential DLk of the data line 114, the plurality of auxiliary capacitive elements Cf(1), . . . , and Cf(i) share the compensation of the lowering of the data line potential DLk.

The plurality of auxiliary correction signals ϕ1, . . . , and ϕi fall from the first potentials Vϕ1*a*, . . . , and Vϕia to the second potentials Vϕ1*b*, . . . , and Vϕib, respectively, before a time at which the sampling signal Si is to be input. Thereafter, at a time at which the scanning signal Yj is not supplied, that is, after one horizontal scanning period is completed, the plurality of auxiliary correction signals ϕ1, . . . , and ϕi are increased from the second potentials Vϕ1*b*, . . . , and Vϕib to the first potentials Vϕ1*a*, . . . , and Vϕia, respectively. As such, by changing the potentials of the plurality of correction signals ϕ1, . . . , and ϕi, the differential voltages ΔVs(1), . . . , and ΔVs(i) between the first potentials Vϕ1*a*, . . . , and Vϕia and the second potentials Vϕ1*b*, . . . , and Vϕib are applied to the plurality of auxiliary capacitive elements Cf(1), . . . , and Cf(i), respectively. The plurality of auxiliary capacitive elements Cf(1), . . . , and Cf(i) increases the potential of the node by the voltage ΔV3 in accordance with the applied differential voltages ΔVs(1), . . . , and ΔVs(i) as a whole. Therefore, similarly to the liquid crystal panel 100*a*, the lowering of the potential of the node N, that is, the electrode potential Vpix of the pixel electrode 9*a* due to the pushdown phenomenon is compensated.

Accordingly, according to the liquid crystal panel of this modification, unlike the above-described liquid crystal panel 100*a*, as compared with a case in which the change in the potential of the node N is compensated by a single capacitive element, an influence of the single capacitive element on other pixel circuits can be reduced. Specifically, since the change in the potential to be compensated by a single auxiliary capacitive element from among the plurality of auxiliary capacitive elements Cf(1), . . . , and Cf(i) is smaller than the first change ΔV2, a change in the electrode potential in a pixel circuit can be suppressed with respect to the change in the potential of the pixel electrode 9*a* in the pixel unit caused by a capacitance unit having a single capacitive element. The compensation of the potential by the plurality of auxiliary capacitive elements is effectively used to increase the display performance in a liquid crystal panel, which is driven by phase development driving.

Like the liquid crystal panel of this modification, when an inversion driving method is used as a driving method, the plurality of auxiliary capacitive elements Cf(1), . . . , and Cf(i) may separately compensate for the changes in electrode potential of the pixel electrodes 9*a* to which the image signals VIDk having different polarities are supplied.

In this embodiment, among the changes in potential of the node N, the first change ΔV2 occurring at the time at which the scanning signal Yj falls and the second change ΔV1 occurring at the time at which the sampling signal Si falls are compensated. Although the plurality of auxiliary capacitive elements Cf(1), . . . , and Cf(i) may be configured to compensate for at least the first change ΔV2 from among the changes in potential, preferably, the auxiliary capacitive elements Cf(1), . . . , and Cf(i) compensate for both the first change ΔV2 and the second change ΔV1.

Next, the waveforms of the plurality of auxiliary correction signals ϕ1, . . . , and ϕi will be described in detail with reference to FIG. 23. For convenience of explanation, FIG. 23 only shows the waveforms of auxiliary correction signals ϕ1, ϕi-1, and ϕi.

As shown in FIG. 23, the correction signal supply circuit 600 correspondingly supplies the plurality of auxiliary correction signals ϕ1, . . . , and ϕi to the plurality of auxiliary correction signal lines 131*a*-1, . . . , and 131*a*-*i* at different timings. The plurality of auxiliary capacitive elements Cf(1), . . . , and Cf(i) compensate for at least the first change ΔV2 from among the first change ΔV2 and the second change ΔV1 along the time axis in a stepwise manner. Specifically, the auxiliary correction signals ϕ1, . . . , and ϕi rise from the second potentials Vϕ1*b*, . . . , and Vϕib to the first potentials Vϕ1*a*, . . . , and Vϕia, respectively, at different timings.

Therefore, according to the liquid crystal panel of this modification, the change in potential can be compensated slowly, as compared with a case in which the plurality of auxiliary capacitive elements Cf(1), . . . , and Cf(i) compensate for the change in the potential of the node N, that is, the change in the electrode potential Vpix, at the same timing, and occurrence of parasitic capacitance in other pixel circuits can be suppressed.

According to the liquid crystal panel of this modification, the first potentials Vϕ1*a*, . . . , and Vϕia may be different from each other, and the second potentials Vϕ1*b*, . . . , and Vϕib may be different from each other. As such, if the first potentials Vϕ1*a*, . . . , and Vϕia, and the second potentials Vϕ1*a*, . . . , and Vϕia can be made settable, the degree of freedom in the set values of the first potentials Vϕ1*a*, . . . , and Vϕia and the second potentials Vϕ1*b*, . . . , and Vϕib for defining the differential voltages ΔVs(1), . . . , and ΔVs(i) can be increased. Similarly, the differential voltages ΔVs(1), . . . , and ΔVs(i) may be different from the plurality of auxiliary correction signals ϕ1, . . . , and ϕi.

In addition, the plurality of auxiliary capacitive elements Cf(1), . . . , and Cf(i) may have different capacitances. As such, the degree of freedom in the set values of the first and second potentials, the differential voltages, and capacitances of the plurality of auxiliary capacitive elements can be increased. Therefore, when the set values of the auxiliary correction signals ϕ1, . . . , and ϕi are limited, the change in the potential of the node N can be compensated by appropriately setting capacitances of the auxiliary capacitive elements Cf(1), . . . , and Cf(i).

Similarly, even if there is a limitation in design or a manufacturing process the auxiliary correction signal supply circuit 600 for outputting the auxiliary correction signals ϕ1, . . . , and ϕi, and accordingly appropriate auxiliary correction signals ϕ1, . . . , and ϕi cannot be supplied to the plurality of auxiliary capacitive elements Cf(1), . . . , and Cf(i), by appropriately setting capacitances of the plurality of auxiliary capacitive elements Cf(1), . . . , and Cf(i), the change in the potential of the node N can be compensated. In addition, capacitance coupling between the node N and other conductive portions, such as wiring lines, can be reduced. Furthermore, coupling capacitance caused by a difference between the common potential LCCOM supplied to the counter electrode and the potential of the node N in a display element, such as a liquid crystal element, can be reduced.

Next, the waveforms of the auxiliary correction signals ϕ1, . . . , and ϕi will be described in detail with reference to FIG. 24.

As shown in FIG. 24, in the liquid crystal panel of this modification, slope portions, which are specified by the changes in potential of the plurality of auxiliary correction signals ϕ1, . . . , and ϕi with respect to the time axis T, in the waveforms of the plurality of auxiliary correction signals ϕ1, . . . , and ϕi have different slopes with respect to the time axis T.

Specifically, the slope portions P1, Pi-1, and Pi in the auxiliary correction signals ϕ1, ϕi-1, and ϕi have different slopes with respect to the time axis T.

With the auxiliary correction signals ϕ1, . . . , and ϕi, by the plurality of auxiliary capacitive elements Cf(1), . . . , and Cf(i), which operate in accordance with the plurality of auxiliary correction signals ϕ1, . . . , and ϕi, respectively, capacitance coupling between the node N and other conductive portions, such as wiring lines, can be reduced. In addition, coupling capacitance caused by the difference between the common potential LCCOM supplied to the counter electrode and the potential of the node N in a display element, such as a liquid crystal element, can be effectively reduced.

In the liquid crystal panel of this embodiment, the correction signal supply circuit 600 may be formed in parallel to at least one of the sampling switch 202 and the TFT 30, and may include a transistor element for a supply circuit having the same design as the at least one transistor element.

According to the correction signal supply circuit 600, a voltage to be compensated in accordance with a single correction signal or a plurality of auxiliary correction signals can be made to be the same as the threshold voltage of at least one of the sampling switch 202 and the TFT 30. In addition, as compared with a case in which the correction signal supply circuit is formed in parallel to at least one of the sampling switch 202 and the TFT 30, and a correction signal or a plurality of auxiliary correction signals are output through a transistor element, which is different from a transistor element for a supply circuit having the same design as the at least one element, a variation in potential between the signals can be reduced.

Other Embodiments

Electronic Apparatus

Next, embodiments of an electronic apparatus, including the above liquid crystal device, according to the invention will be described.

Mobile Computer

Figure 25:
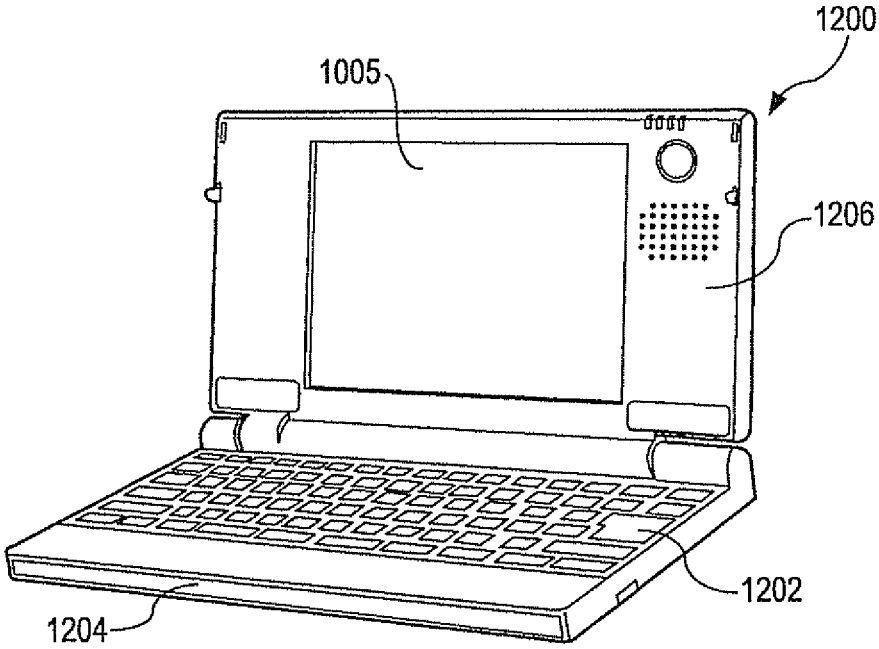
FIG. 25 is a perspective view of a personal computer as an embodiment of an electronic apparatus according to the invention.

First, an example in which the liquid crystal device is applied to a mobile personal computer will be described. FIG. 25 is a perspective view showing the configuration of the personal computer. Referring to FIG. 25, a computer 1200 includes a body portion 1204 having a keyboard 1202 and a liquid crystal display unit 1206. The liquid crystal display unit 1206 is formed by attaching a backlight to the rear surface of a liquid crystal device 1005.

Mobile Phone

Figure 26:
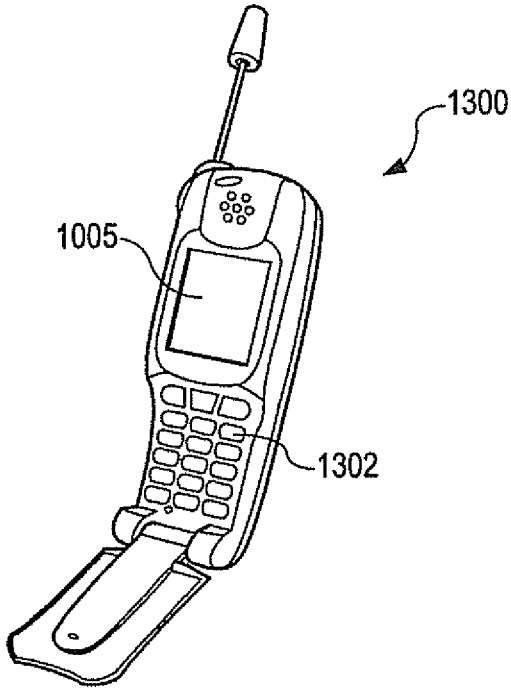
FIG. 26 is a perspective view of a mobile phone as another embodiment of an electronic apparatus according to the invention.

Next, an example in which the liquid crystal device is applied to a mobile phone will be described. FIG. 26 is a perspective view showing the configuration of the mobile phone. Referring to FIG. 26, a mobile phone 1300 includes a plurality of operating buttons 1302, and a reflective liquid crystal device 1005. As for the reflective liquid crystal device 1005, as occasion demands, a front light is provided on the front surface of the liquid crystal device.

Projector

Figure 27:
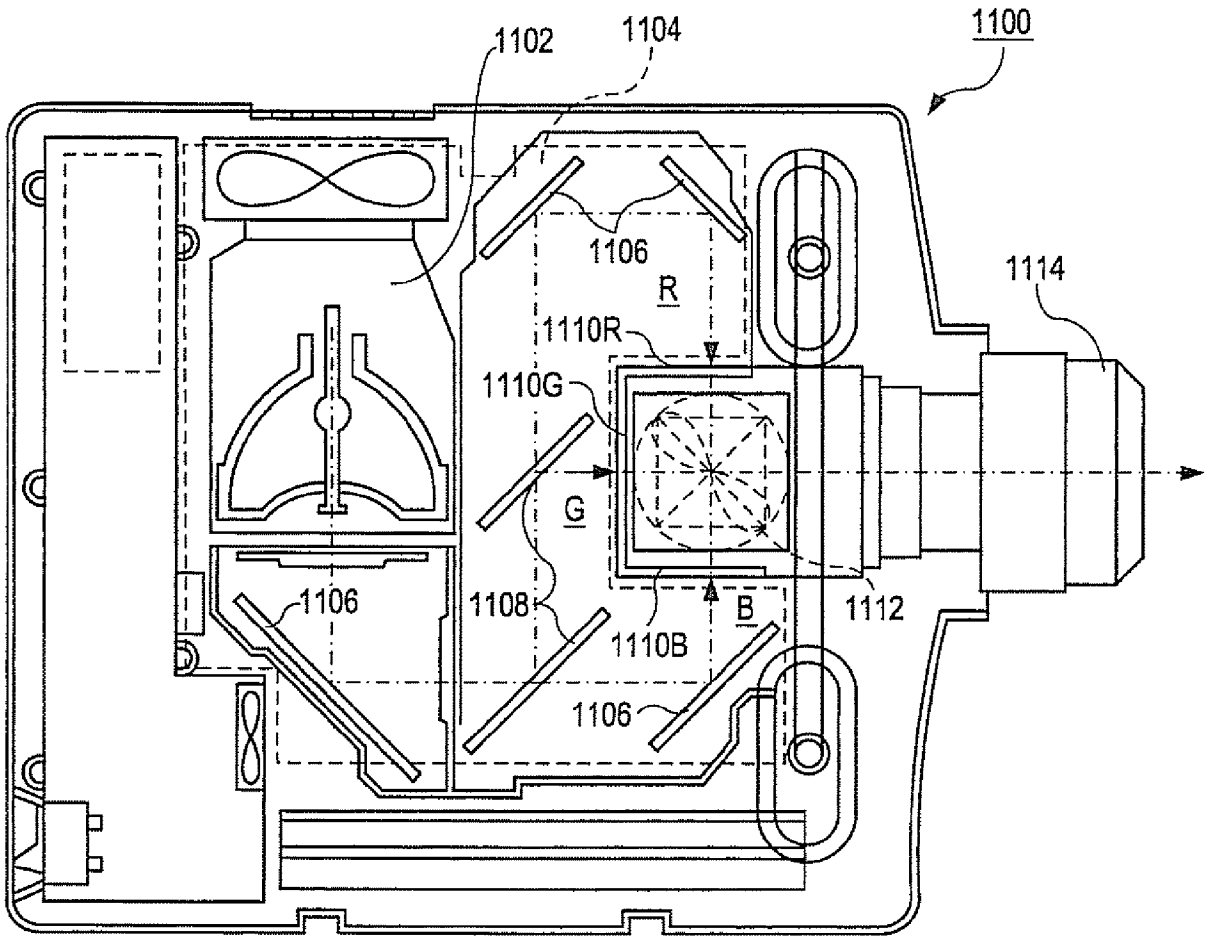
FIG. 27 is a plan view showing the configuration of a projector as another embodiment of an electronic apparatus according to the invention.

Next, an example of a projection-type display device using the liquid crystal panel 100 will be described with reference to FIG. 27. The projection-type display device of this embodiment is an example of an 'electronic apparatus' in the invention. The projection-type display device of this embodiment is a projector that uses the liquid crystal panel 100 as a light valve. This projector has an optical system, in which retardation films are arranged on a light incident side and a light emission side of the light valve. FIG. 27 is a plan view showing the configuration of a projector according to this embodiment.

As shown in FIG. 27, in a projector 1100, a lamp unit 1102 having a white light source, such as a halogen lamp, is provided. Projection light emitted from the lamp unit 1102 is separated into three light components of three primary colors of R (red), G (green), and B (blue) by four mirrors 1106 and two dichroic mirrors 1108 disposed in a light guide 1104. The separated light components are incident on liquid crystal panels 1110R, 1110B, and 1110G serving as light valves corresponding to the primary colors.

The liquid crystal panels 1110R, 1110B, and 1110G have the same configuration as the above-described liquid crystal device, and are driven by the primary color signals of R, G, and B supplied from an image signal processing circuit. Then, the light components incident on or emitted from the liquid crystal panels are optically compensated by the retardation films. The light components emitted from the liquid crystal panel and the optical system including the retardation films are incident on a dichroic prism 1112 from three directions. In the dichroic prism 1112, the light components of R and B are refracted by 90 degrees and the light component of G passes through straight. Therefore, the images of the respective colors are combined and then projected as a color image on a screen through a projection lens 1114.

As for display images by the liquid crystal panels 1110R, 1110B, and 1110G, the display image by the liquid crystal panel 1110G must be left-right reversed with respect to the display images by the liquid crystal panels 1110R and 1110B.

The light components corresponding to the primary colors of R, G, and B are incident on the liquid crystal panels 1110R, 1110B, and 1110G by the dichroic mirror 1108, and thus no color filter is needed.

Such a projector includes the above liquid crystal panel, and thus it can display a high-definition image with a predetermined panel size.

The liquid crystal panel of this embodiment is not limited to the application to the projection-type display device, but it may constitute a part of a direct-view-type liquid crystal display. In addition, the liquid crystal panel may constitute a LCOS-type liquid crystal device.

In addition to the electronic apparatuses described with reference to FIGS. 25 to 27, there can be further electronic apparatuses, such as a liquid crystal television, a viewfinder-type or a monitor-direct-view-type video tape recorder, a car navigation device, a pager, an electronic organizer, an electronic calculator, a word processor, a workstation, a video phone, a POS terminal, and a device including a touch panel. Of course, the invention can be applied to these electronic apparatuses.

It should be understood that the invention is not limited to the foregoing embodiments, but various changes and modifications may be made within the scope of the invention departing from the subject matter and spirit of the invention read on the appended claims and the entire specification. Also, an electro-optical device and an electronic apparatus including the electro-optical device that accompany such changes and modifications still fall within the technical scope of the invention.

The entire disclosure of Japanese Patent Application Nos: 2007-243441, filed Sep. 20, 2007 and 2007-243442, filed Sep. 20, 2007 are expressly incorporated by reference herein.

What is claimed is:

1. An electro-optical device, comprising:

a plurality of data lines and a plurality of scanning lines that are formed to intersect each other in a display region on a substrate; and a plurality of pixel circuits that control driving of a plurality of pixel circuits correspondingly provided at intersections of the plurality of data lines and the plurality of scanning lines, each of the pixel circuits including:

a driving electrode that drives a corresponding display element, a driving transistor element that controls drive of the corresponding display element through the driving electrode, the driving transistor element having an input terminal that is electrically connected to a corresponding data line and to which an image signal is input through the data line, an output terminal that is electrically connected to the driving electrode and outputs the image signal to the driving electrode, and a gate electrode that is electrically connected to a corresponding scanning line, a storage capacitor that holds the electrode potential of the driving electrode set according to the potential of the image signal, the storage capacitor having a first capacitor electrode that is electrically connected to a fixed potential line to which a fixed potential is supplied, the storage capacitor having a second capacitor electrode that is electrically connected to a node in a connection path electrically connecting the driving electrode and the output terminal together, and a capacitance unit that is electrically connected between the node and a correction signal line to which a correction signal is supplied from a correction signal supply circuit, the capacitance unit compensating for a first change in potential of the node in accordance with the correction signal when the driving transistor element is switched from a selection state to a non-selection state;

a sampling circuit that has a sampling switch for sampling the image signal and supplying the sampled image signal to the data line, and a data line driving circuit that switches the sampling switch from the non-selection state to the selection state such that the image signal is supplied to the data line by the sampling switch the correction signal supply circuit changes the potential of the correction signal from the first potential to the second potential ahead of a second time at which the sampling switch is to be switched from the selection state to the non-selection state, and the capacitance unit compensates for a second change in the potential of the node when the sampling switch is switched from the selection state to the non-selection state;

wherein the correction signal line includes a plurality of auxiliary correction signal lines, the correction signal includes a plurality of auxiliary correction signals that are supplied to the plurality of auxiliary correction signal lines from the correction signal supply circuit, the capacitance unit includes a plurality of auxiliary capacitance units that are electrically connected to the node, and the plurality of auxiliary capacitance units share compensation of at least the first change from among the first change and the second change in accordance with the plurality of auxiliary correction signal lines.

2. The electro-optical device according to claim 1, wherein the correction signal supply circuit changes the potential of the correction signal from a first potential to a second potential ahead of a first time at which the driving transistor element is to be switched from the selection state to the non-selection state, and changes the potential of the correction signal from the second potential to the first potential after the first time.

3. The electro-optical device according to claim 1, wherein a combination of a differential voltage, which is a difference between the first potential and the second potential, and capacitance of the capacitance unit is set so as to compensate for at least the first change from among the first change and the second change.

4. The electro-optical device according to claim 1, wherein the correction signal supply circuit correspondingly supplies the plurality of auxiliary correction signals to the plurality of auxiliary correction signal lines at different timings, and the plurality of auxiliary capacitance units compensate for at least the first change from among the first change and the second change along a time axis in a stepwise manner.

5. The electro-optical device according to claim 4, wherein slope portions, which are specified by the changes in potential of the plurality of auxiliary correction signals with respect to the time axis, in the waveforms of the plurality of auxiliary correction signals have different slopes with respect to the time axis.

6. The electro-optical device according to claim 1, wherein the plurality of auxiliary capacitance units have different capacitances.

7. The electro-optical device according to claim 1, wherein the first potential varies in accordance with the plurality of auxiliary correction signals, and the second potential varies in accordance with the plurality of auxiliary correction signals.

8. The electro-optical device according to claim 1, wherein a differential voltage, which is difference between the first potential and the second potential in each of the plurality of auxiliary correction signals, varies in accordance with the plurality of auxiliary correction signals.

9. The electro-optical device according to claim 1, wherein the sampling switch is a sampling transistor element, and the correction signal supply circuit is formed in parallel to at least one of the sampling transistor element and the driving transistor element, and includes a transistor element for a supply circuit having the same design as the one transistor element.

10. An electronic apparatus comprising the electro-optical device according to claim 1.

* * * * *